US012622460B2

(12) United States Patent
Lee et al.

(10) Patent No.: US 12,622,460 B2
(45) Date of Patent: May 12, 2026

(54) AEROSOL GENERATING DEVICE COMPRISING CARTRIDGE

(71) Applicant: KT&G CORPORATION, Daejeon (KR)

(72) Inventors: Won Kyeong Lee, Gyeonggi-do (KR); Jong Sub Lee, Gyeonggi-do (KR); Byung Sung Cho, Gyeonggi-do (KR)

(73) Assignee: KT&G Corporation, Daejeon (KR)

( * ) Notice: Subject to any disclaimer, the term of this patent is extended or adjusted under 35 U.S.C. 154(b) by 779 days.

(21) Appl. No.: 17/928,142

(22) PCT Filed: Aug. 11, 2022

(86) PCT No.: PCT/KR2022/012010

§ 371 (c)(1),
(2) Date: Nov. 28, 2022

(87) PCT Pub. No.: WO2023/018249

PCT Pub. Date: Feb. 16, 2023

(65) Prior Publication Data

US 2024/0225102 A1 Jul. 11, 2024

(30) Foreign Application Priority Data

Aug. 12, 2021 (KR) ..... 10-2021-0106935
Oct. 6, 2021 (KR) ..... 10-2021-0132689

(51) Int. Cl.
*A24F 40/42* (2020.01)
*A24F 40/485* (2020.01)

(52) U.S. Cl.
CPC ..... *A24F 40/42* (2020.01); *A24F 40/485* (2020.01)

(58) Field of Classification Search
None
See application file for complete search history.

(56) References Cited

U.S. PATENT DOCUMENTS 11,576,431 B1 * 2/2023 Wiedemann ..... A24F 1/30
2010/0063408 A1 3/2010 Nothacker et al.
2014/0102463 A1 * 4/2014 Jones ..... A61M 15/06 131/329
2014/0283824 A1 9/2014 Wheelock et al.
2015/0053217 A1 2/2015 Steingraber et al.
(Continued)

FOREIGN PATENT DOCUMENTS

CN 207767550 U 8/2018
CN 112165871 A 1/2021
(Continued)

OTHER PUBLICATIONS

Extended European Search Report dated Mar. 19, 2024 in Application No. 22801954.3.
(Continued)

*Primary Examiner* — Michael J Felton
(74) *Attorney, Agent, or Firm* — Foley & Lardner LLP

(57) ABSTRACT

The aerosol generating device includes: a cartridge including a mouthpiece movable between an open position and a closed position, and a body portion storing an aerosol generating material and including a first airflow passage in which airflow moves; and a main body including a coupling portion detachably coupled to the cartridge, and a holding portion holding the mouthpiece in the closed position.

14 Claims, 8 Drawing Sheets

(56) References Cited

U.S. PATENT DOCUMENTS

| | | | | |
|---|---|---|---|---|
| 2016/0050975 | A1* | 2/2016 | Worm | A24F 15/01 131/328 |
| 2017/0027228 | A1 | 2/2017 | Rastogi | |
| 2019/0208817 | A1 | 7/2019 | Qiu et al. | |
| 2022/0039465 | A1 | 2/2022 | Du et al. | |
| 2022/0248768 | A1 | 8/2022 | Lee et al. | |

FOREIGN PATENT DOCUMENTS

| | | | |
|---|---|---|---|
| CN | 212306814 | U | 1/2021 |
| CN | 113226074 | A | 8/2021 |
| CN | 113243563 | A | 8/2021 |
| EP | 4 088 593 | A1 | 11/2022 |
| KR | 10-2020-0030898 | A | 3/2020 |
| KR | 10-2020-0123691 | A | 10/2020 |
| KR | 10-2190982 | B1 | 12/2020 |
| WO | 2017/019123 | A1 | 2/2017 |
| WO | 2018/092095 | A1 | 5/2018 |
| WO | WO-2020/055043 | A1 | 3/2020 |
| WO | 2020/115321 | A1 | 6/2020 |
| WO | 2020/128491 | A1 | 6/2020 |
| WO | 2021/005365 | A1 | 1/2021 |
| WO | 2022/114705 | A1 | 6/2022 |

OTHER PUBLICATIONS

Japanese Office Action dated Jan. 9, 2024 in Application No. 2022-571891.

International Search Report with Written Opinion of the International Searching Authority dated Nov. 18, 2022 in International Application No. PCT/KR2022/012010.

Chinese Office Action on CN Patent Application No. 202280004680.7 dated Jan. 14, 2026.

* cited by examiner

[Fig. 1]
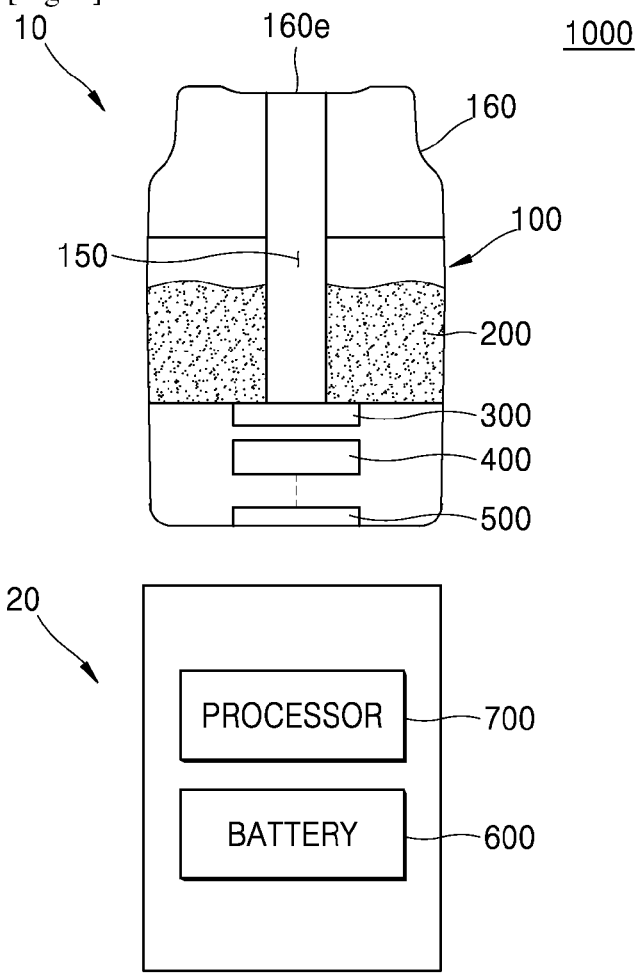

[Fig. 2]
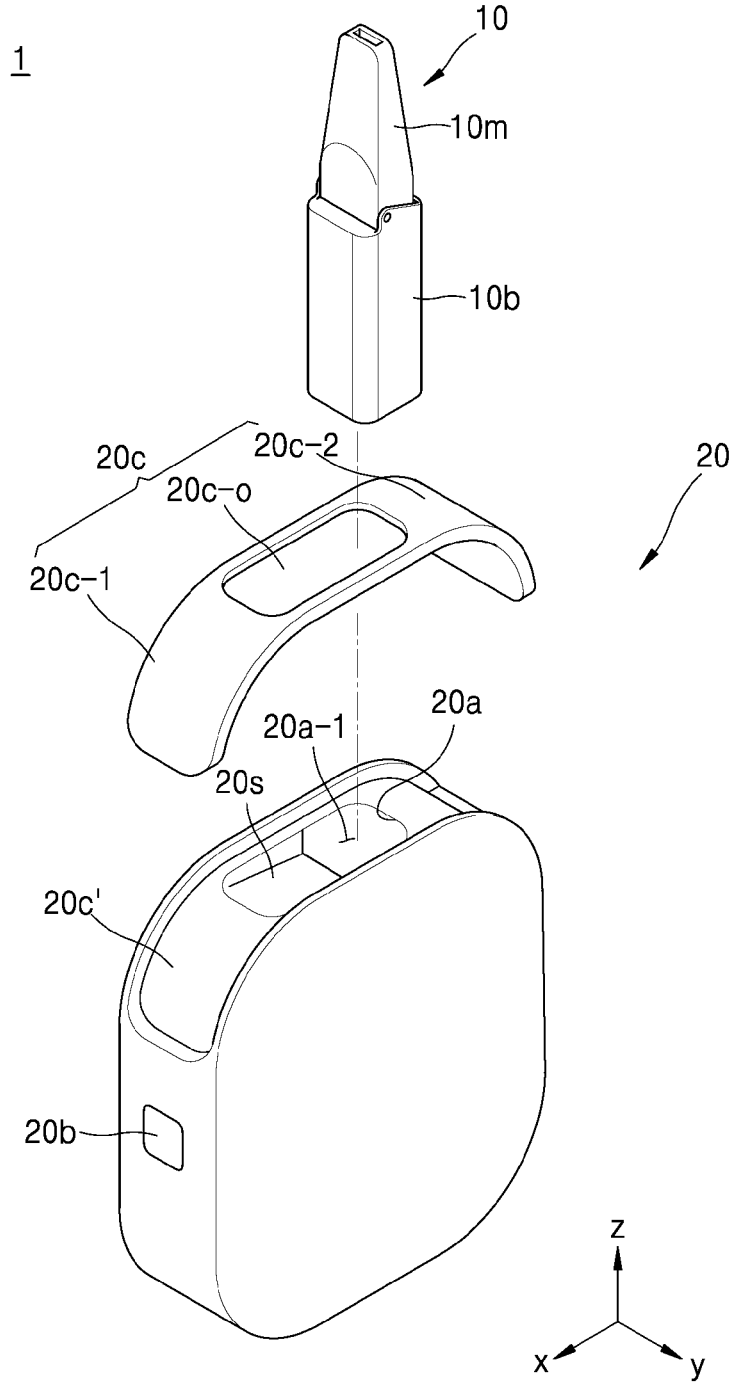

[Fig. 3]
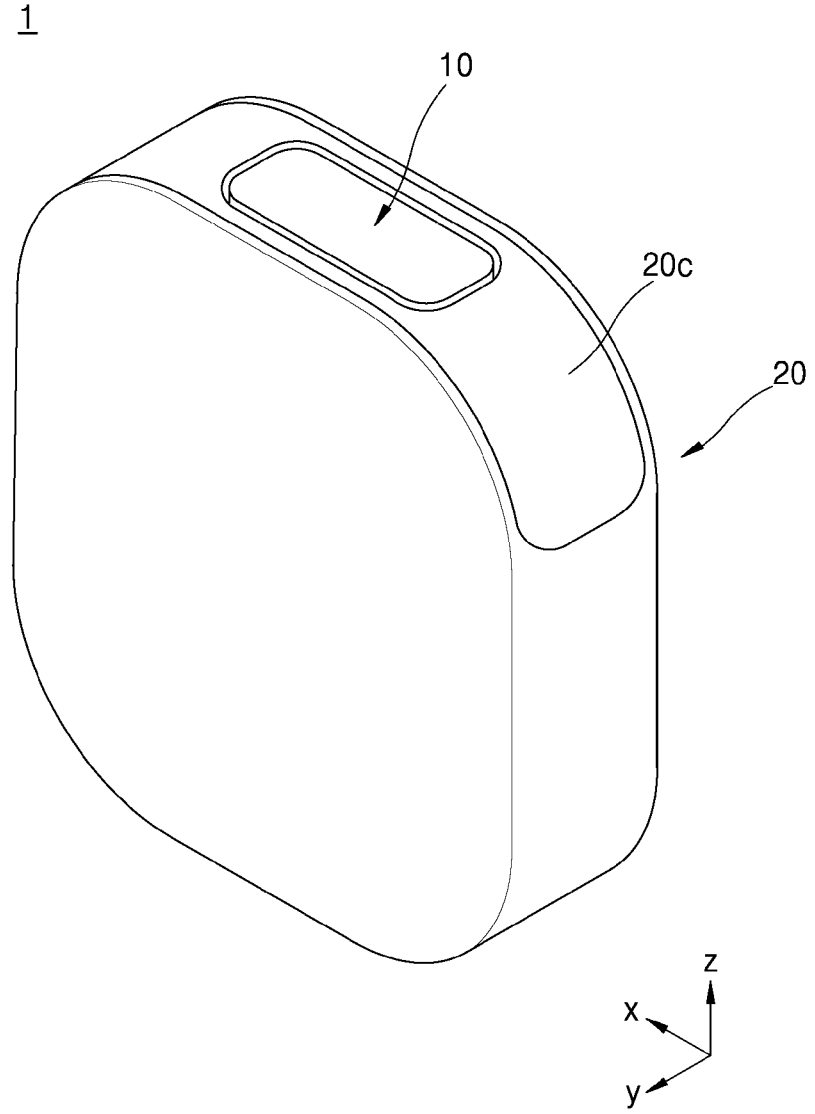

[Fig. 4]
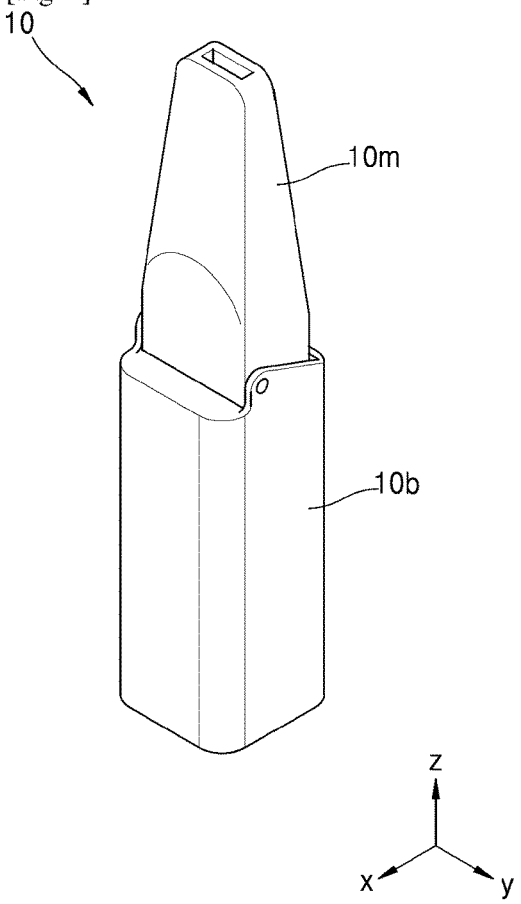
[Fig. 5]
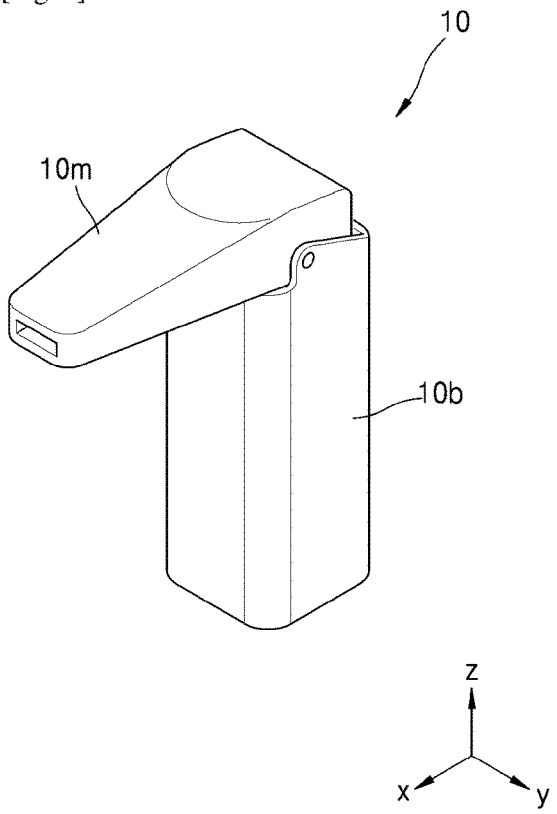

[Fig. 6]
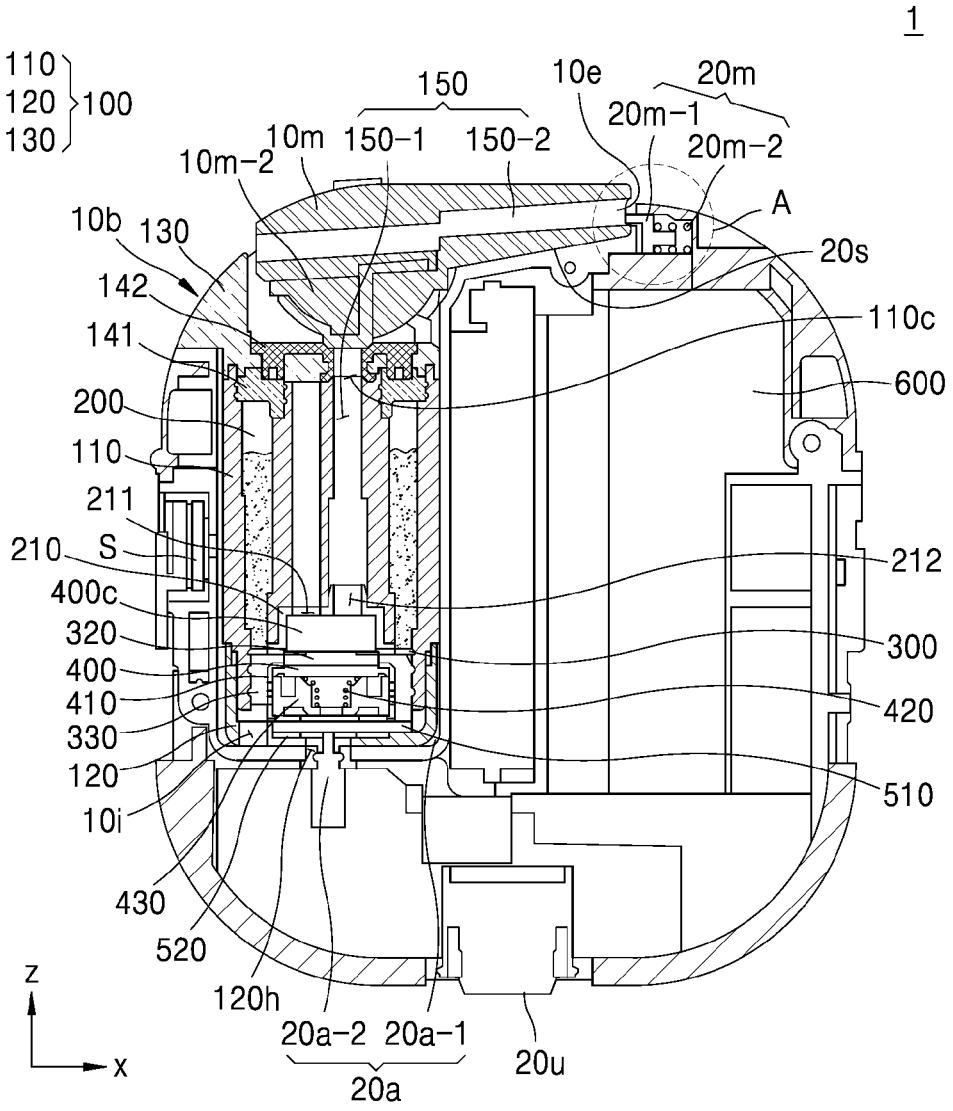

[Fig. 7]
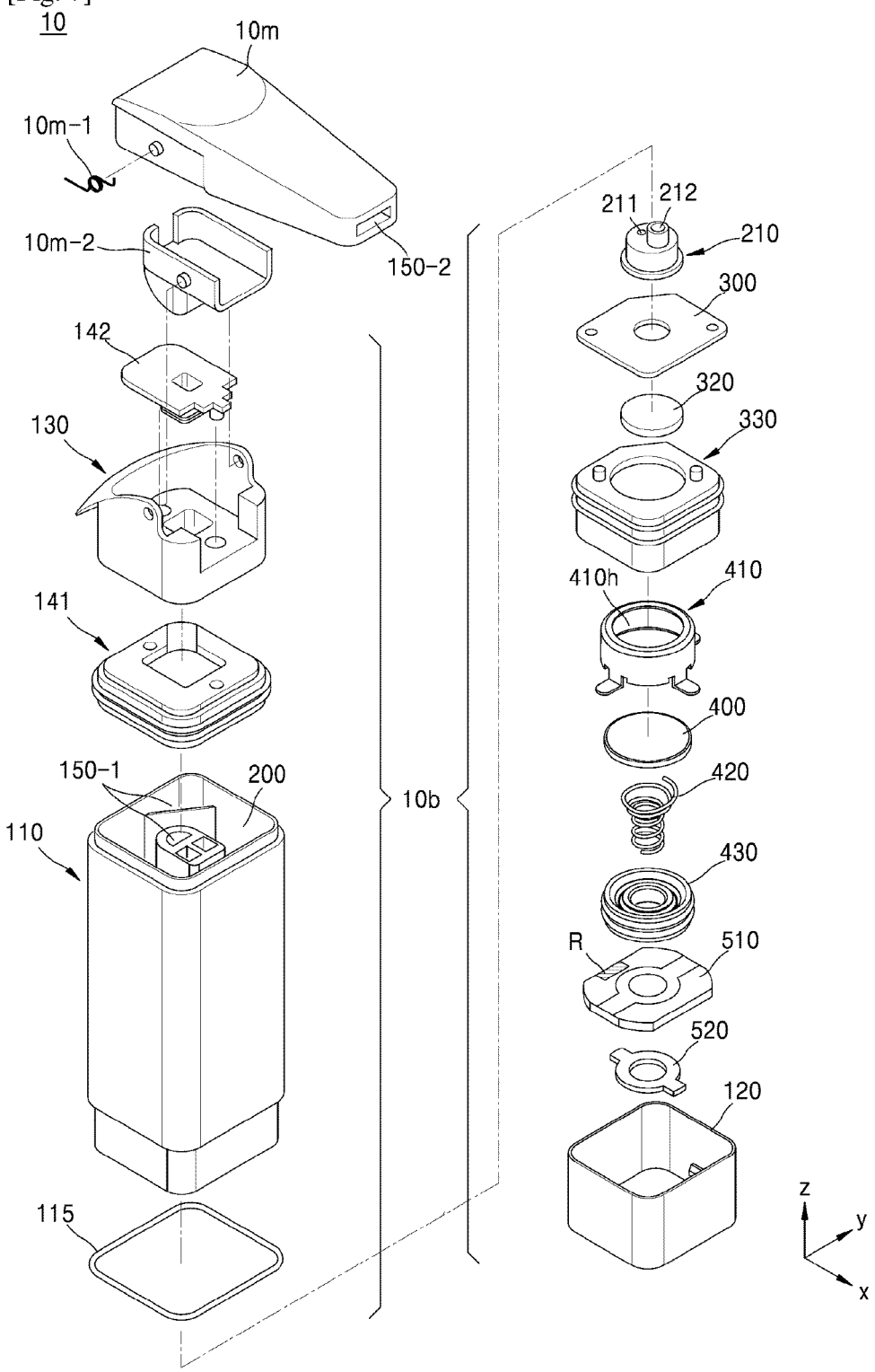

[Fig. 8A]
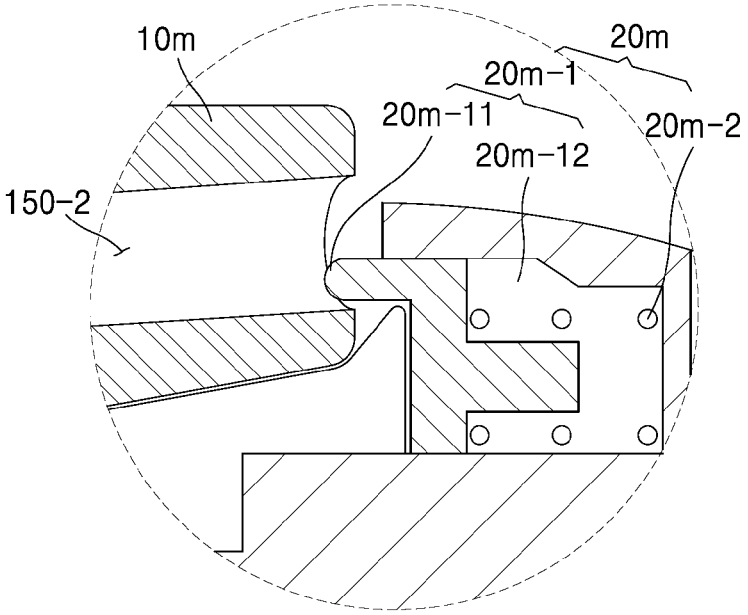
[Fig. 8B]
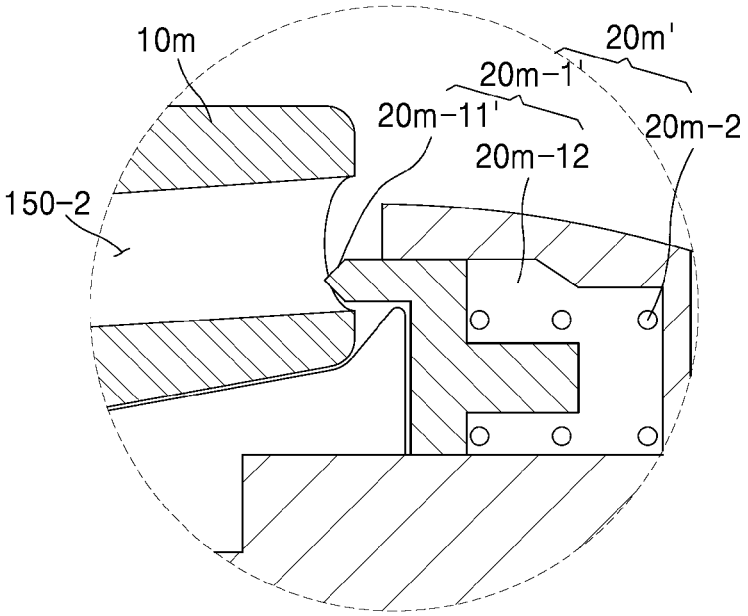

AEROSOL GENERATING DEVICE COMPRISING CARTRIDGE

CROSS REFERENCE TO RELATED APPLICATIONS

This application is a National Stage of International Application No. PCT/KR2022/012010 filed Aug. 11, 2022, claiming priority based on Korean Patent Application No. 10-2021-0106935 filed Aug. 12, 2021 and Korean Patent Application No. 10-2021-0132689 filed Oct. 6, 2021.

TECHNICAL FIELD

The disclosure relates to an aerosol generating device including a cartridge, and more particularly, to an aerosol generating device including a cartridge provided with a movable mouthpiece.

BACKGROUND ART

In recent years, there has been an increasing demand for an alternative method that overcomes the disadvantages of conventional cigarettes. For example, there is growing demand for an aerosol generating device which generates aerosols by heating an aerosol generating material, rather than by combustion of cigarettes. Accordingly, research on a heating-type aerosol generating device have been actively conducted.

A heating-type aerosol generating device may include, for example, a cartridge that stores an aerosol generating material in a liquid or gel state and atomizes the stored aerosol generating material. The cartridge may be provided with a mouthpiece for a user to inhale through the aerosol generating device.

DISCLOSURE OF INVENTION

Technical Problem

The mouthpiece protruding from the aerosol generating device may increase the size and reduce the portability of the aerosol generating device.

Thus, there is a need for an aerosol generating device including a cartridge that is designed to improve convenience of the user.

Objects to be achieved by the embodiments are not limited to the above-described objects, and objects not described may be clearly understood by those skilled in the art to which the embodiments belong from the present specification and the accompanying drawings.

Solution to Problem

According to one or more embodiments, an aerosol generating device may include a cartridge including a mouthpiece movable between an open position and a closed position, and a body portion storing an aerosol generating material and including a first airflow passage in which airflow moves, and a main body including a coupling portion detachably coupled to the cartridge, and a holding portion holding the mouthpiece in the closed position.

Advantageous Effects of Invention

An aerosol generating device according to one or more embodiments may be provided with a movable mouthpiece to thereby become minimized in size.

In addition, the aerosol generating device according to one or more embodiments may simply and firmly maintain the mouthpiece located at the closed position, thereby improving user's convenience.

However, effects of the embodiments are not limited to the above effects, and effects that are not mentioned could be clearly understood by one of ordinary skill in the art from the present specification and the attached drawings.

BRIEF DESCRIPTION OF DRAWINGS

FIG. 1 is a schematic view of an aerosol generating device according to an embodiment.

FIG. 2 is a perspective view of an aerosol generating device in which a cartridge and a main body are separated from each other.

FIG. 3 is a perspective view of the aerosol generating device of FIG. 2 in which the cartridge is coupled to the main body.

FIG. 4 is a view illustrating an aspect of the cartridge according to an embodiment of FIG. 2.

FIG. 5 is a view illustrating another aspect of the cartridge according to an embodiment of FIG. 2.

FIG. 6 is a cross-sectional view of the aerosol generating device according to an embodiment of FIG. 2.

FIG. 7 is an exploded perspective view of the cartridge according to an embodiment of FIG. 2.

FIG. 8A is an enlarged view of part A in FIG. 6.

FIG. 8B is an enlarged view of a modified example of part A in FIG. 6.

BEST MODE FOR CARRYING OUT THE INVENTION

Figure 9:
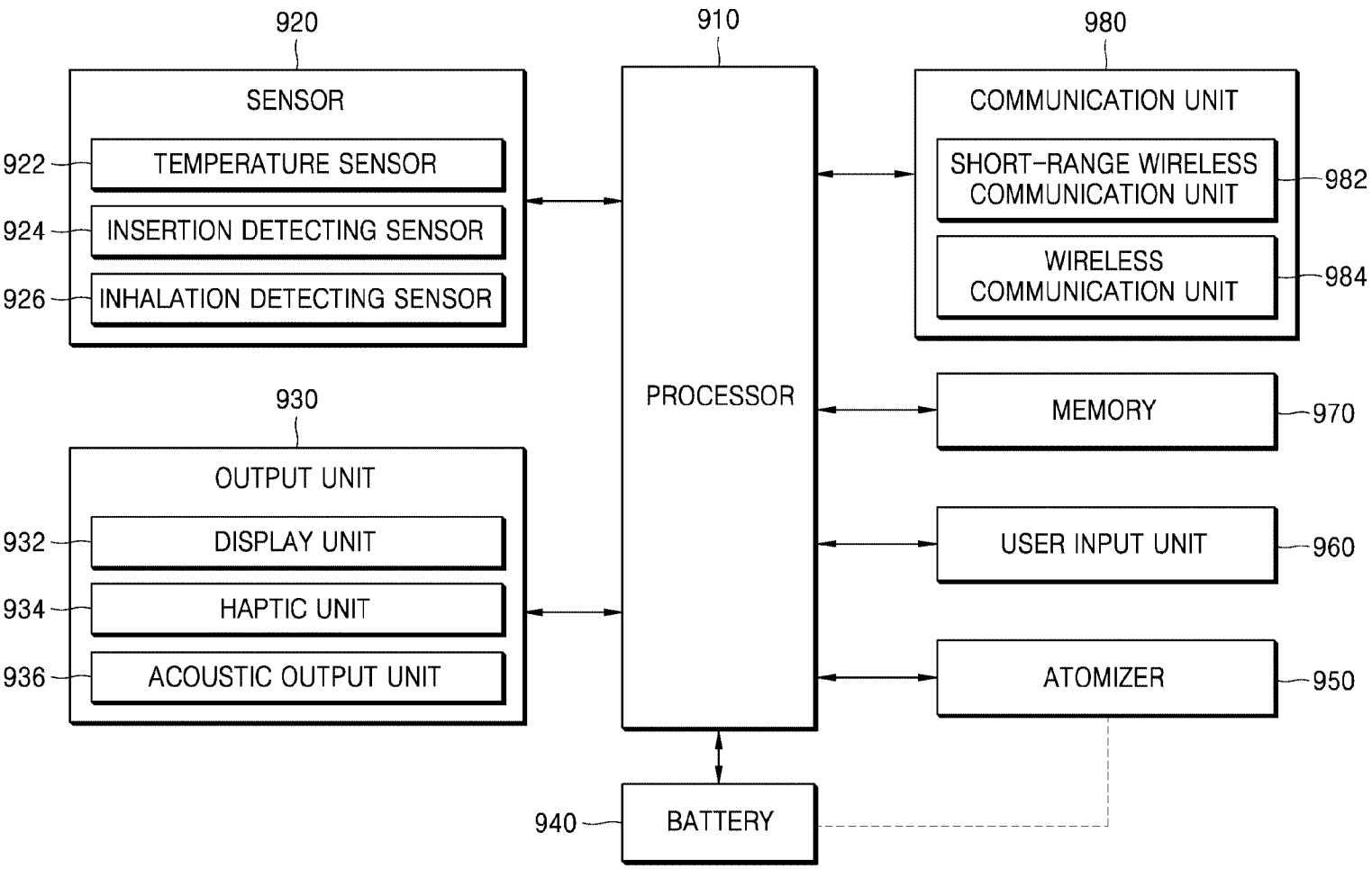
FIG. 9 is a block diagram of an aerosol generating device according to another embodiment.

According to an embodiment, an aerosol generating device may include: a cartridge comprising a mouthpiece configured to move between an open position and a closed position, and a body portion configured to store an aerosol generating material and comprising a first airflow passage in which airflow moves; and a main body comprising a coupling portion detachably coupled to the cartridge, and a holding portion configured to hold the mouthpiece in the closed position.

The holding portion may provide a holding force to one end of the mouthpiece to hold the mouthpiece in the closed position.

The cartridge may further comprise a first elastic body elastically supporting the mouthpiece toward the open position.

The mouthpiece may be rotatable around a rotation shaft, and the first elastic body may be a torsion spring located at the rotation shaft of the mouthpiece.

The holding portion may comprise a locking unit that is coupled to the mouthpiece when the mouthpiece moves to the closed position such that the mouthpiece is held in the closed position.

The holding portion may further comprise a second elastic body configured to press the locking unit in one direction, and when the mouthpiece moves from the closed position to the open position, the second elastic body is pressed to another direction such that the mouthpiece and the locking unit are uncoupled.

The mouthpiece may comprise a second airflow passage of which one end is connected to an outside of the aerosol generating device, and of which another end is connected to the first airflow passage in the open position.

The cartridge may further comprise an atomizer, and the coupling portion may comprise an accommodating groove accommodating the body portion, and a connection terminal electrically connected to the atomizer.

The main body may further comprise a cover comprising an opening having a size corresponding to the mouthpiece, and wherein the cover is coupled to one side of the main body to which the cartridge is coupled such that a coupling state of the cartridge and the main body is maintained.

The cartridge may further comprise an atomizer, and a storage, wherein the body portion may further comprise a first housing forming a portion of the first airflow passage of the storage, and a second housing coupled to the first housing and forming remaining portions of the first airflow passage and an inner space accommodating the atomizer.

The cartridge may further comprise an atomizer, a first conductor connected to one surface of the atomizer, a second conductor connected to another surface of the atomizer.

The first conductor may cover at least a portion of the one surface of the atomizer and at least a portion of an outer circumferential surface of the atomizer, and the second conductor may elastically pressurize the atomizer in a direction from the other surface of the atomizer to the one surface of the atomizer.

The cartridge may further comprise a circuit board electrically connected to the atomizer through the first conductor and the second conductor, and the circuit board may comprise a resistor that eliminates noise of a signal applied to the atomizer.

The cartridge may further comprise an atomizer, a storage, a wick that absorbs the aerosol generating material stored in the storage, and an absorbing plate arranged to cover at least a portion of the atomizer and configured to retain the aerosol generating material absorbed by the wick.

The main body may further comprise an inhalation detecting sensor located at the coupling portion.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, when an expression such as "at least one" precedes a series of elements, the expression modifies all elements rather than each of the elements. For example, the expression "at least one of a, b, and c" indicates only a, only b, only c, both a and b, both a and c, both b and c, all of a, b, and c, or variations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

In addition, while such terms as "first," "second," etc., may be used to describe various components, such components must not be limited to the above terms. Terms are used only for the purpose of distinguishing one component from another component.

In addition, some of the component in the drawings may be illustrated with a slightly exaggerated size, proportion, or the like. In addition, components shown in some drawings may not be shown in other drawings.

In addition, throughout the specification, the "longitudinal direction" of a component may be a direction in which the component extends along one axis of the component, and in this case, the one axis of the component may refer to a direction in which the component extends longer than the other axis transverse to the one axis.

Throughout the specification, the term "puff" refers to the user's inhalation, and the inhalation may refer to a situation in which air is drawn into the user's mouth, nasal cavity, or lungs through the user's mouth or nose.

Throughout the specification, 'embodiments' are arbitrary divisions for easily describing the inventive concept in the present disclosure, and the embodiments are not necessarily mutually exclusive. For example, configurations disclosed in an embodiment may be applied and/or implemented in other embodiments and may be modified and applied and/or implemented without departing from the scope of the present disclosure. In the present disclosure, a singular form also includes a plural form unless specifically stated in otherwise.

Hereinafter, the present disclosure will be described more fully with reference to the accompanying drawings, in which embodiments of the present disclosure are shown such that one of ordinary skill in the art may easily understand the present disclosure. However, the present disclosure may be embodied in many different forms and should not be construed as being limited to the embodiments set forth herein.

FIG. 1 is a schematic view of an aerosol generating device according to an embodiment.

Referring to FIG. 1, an aerosol generating device may include a cartridge 10 storing an aerosol generating material and a main body 20 supporting the cartridge 10.

The cartridge 10 may be coupled to the main body 20 in a state of accommodating an aerosol generating material therein. For example, because at least a portion of the cartridge 10 is inserted into the main body 20, the cartridge 10 may be coupled to the main body 20. As another example, by inserting at least a portion of the main body 20 into the cartridge 10, the cartridge 10 may be coupled to the main body 20.

The cartridge 10 and the main body 20 may be coupled to each other by at least one of a snap-fit method, a screw connection method, a magnetic force coupling method, or a forcible fitting method, but a method of coupling the cartridge 10 and the main body 20 is not limited to the examples described above.

According to an embodiment, the cartridge 10 may include a housing 100, a mouthpiece 160, a reservoir 200, a wick 300, the atomizer 400, and an electrical connection member 500.

The housing 100 may form an overall outer shape of the cartridge 10 together with the mouthpiece 160, and the components for the operation of the cartridge 10 may be arranged in the housing 100. According to an embodiment, the housing 100 may be formed in a cuboid shape, but the shape of the housing 100 is not limited thereto. According to an embodiment, the housing 100 may be formed in a polygonal column (e.g., a triangular column, a pentagon column) shape or a cylindrical shape.

The mouthpiece 160 may disposed in one area of the housing 100 and may include an outlet 160*e* for discharging the aerosol generated from the aerosol generating material to the outside. In one embodiment, the mouthpiece 160 may be disposed in the other area located in a direction opposite to the area of the cartridge 10 that is coupled to the main body 20, and the user may be provided with aerosol from the cartridge 10 by contacting the mouth with the mouthpiece 160 and inhaling.

A pressure difference between the outside of the cartridge 10 and the inside of the cartridge 10 may occur due to an inhalation or puff operation of the user, and because of the pressure difference between the inside and outside of the cartridge 10, the aerosol generated inside the cartridge 10 may be discharged to the outside of the cartridge 10 through the outlet 160*e*. The user may be supplied with aerosol being discharged to the outside of the cartridge 10 through the outlet 160*e* by contacting the mouth with the mouthpiece 160 and inhaling.

The storage 200 may be located inside the housing 100 and may accommodate the aerosol generating material. When "the storage accommodates the aerosol generating material therein", it means that the storage 200 functions as a container simply holding an aerosol generating material and that the storage 200 includes therein an element impregnated with (or containing) an aerosol generating material, such as a sponge, cotton, fabric, or porous ceramic structure. Further, the above expression may be used with the same meaning here below.

In the storage 200, aerosol generating materials, for example, in any one state among a liquid state, a solid state, a gas state, or a gel state may be accommodated.

In an embodiment, the aerosol generating material may include a liquid composition. The liquid composition may be a liquid including a tobacco-containing material having a volatile tobacco flavor component, or a liquid including a non-tobacco material.

For example, the liquid composition may include one component of water, solvents, ethanol, plant extracts, spice, flavoring, and vitamin mixtures, or a mixture of these components. The flavoring may include, but is not limited to, menthol, peppermint, spearmint oil, various fruit flavoring ingredients, or the like.

The flavoring agent may include ingredients capable of providing a user with a variety of flavors or savors. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include a solution of glycerin or propylene glycol in any weight ratio, to which a nicotine salt has been added. The liquid composition may include two or more types of nicotine salts. The nicotine salts may be formed by adding, to nicotine, a suitable acid including organic or inorganic acid. The nicotine is naturally occurring nicotine or synthetic nicotine and may have any suitable weight concentration relative to the total solution weight of the liquid composition.

The acid for the formation of the nicotine salts may be appropriately selected in consideration of the rate of absorption of nicotine in the blood, the operating temperature of the aerosol generating device 1000, flavor or fragrance, solubility, and the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The wick 300 may absorb the aerosol generating material. According to an embodiment, the aerosol generating material stored or accommodated in the storage 200 may be delivered from the storage 200 to the atomizer 400 through the wick 300, and the atomizer 400 may generate aerosol by atomizing the aerosol generating material of the wick 300 or the aerosol generating material delivered from the wick 300. In this case, the wick 300 may include at least one of cotton fibers, ceramic fibers, glass fibers, and porous ceramics, but embodiments of the wick 300 are not limited thereto.

The atomizer 400 may be located inside the housing 100 and may convert a phase of the aerosol generating material stored in the cartridge 10 to generate aerosol. The atomizer 400 may generate aerosol, for example, by heating or vibrating the aerosol generating material.

According to one embodiment, the atomizer 400 of the aerosol generating apparatus 1000 may convert the phase of the aerosol generating material by using an ultrasonic vibration method that atomizes the aerosol generating material with ultrasonic vibration.

For example, the atomizer 400 may include a vibrator that generates short periods of vibrations, and the vibrations generated from the vibrator may be ultrasonic vibrations. The frequency of the ultrasonic vibrations may be about 100 kHz to about 3.5 MHz, but is not limited thereto.

The aerosol generating material supplied to the atomizer 400 from the storage 200 by short periods of vibrations generated from the atomizer 400 may be vaporized and/or changed to particles and atomized to an aerosol.

The vibrator may include, for example, a piezoelectric ceramic, which may be a functional material capable of converting an electrical force to a mechanical force and vice versa by generating electricity (e.g., a voltage) in response to a physical force (e.g., a pressure) and generating a vibration (i.e., a mechanical force) in response to electricity. That is, as electricity is applied to the vibrator, vibrations (physical force) of short periods may be generated, and the generated vibrations break down the aerosol generating material to small particles to thereby atomize to an aerosol.

The vibrator may be electrically connected to other components of the aerosol generating device 1000 through the electrical terminal 500. The electrical terminal 500 may be located on one side of the cartridge 10. For example, the electrical terminal 500 may be located in the coupling surface of the cartridge 10 where the cartridge 10 is coupled to main body 20 of the aerosol generating device 1000. The electrical terminal 500 may be located on a surface of the housing 100 facing the mouthpiece 160.

According to an embodiment, the vibrator may be electrically connected to at least one of a battery 600 and a processor 700 of the main body 20 and a driving circuit of the aerosol generating device 1000 through the electrical terminal 500 located inside the housing 100 of the cartridge 10.

For example, the atomizer 400 may be electrically connected to the electrical terminal 500 located inside the cartridge 10 through a first conductor, and the electrical terminal 500 may be electrically connected to the battery 600 and processor 700 of the main body 20 and/or other driving circuits through a second conductor. That is, the vibrator may be electrically connected to the elements of the main body 20 via the electrical terminal 500.

The vibrator may generate ultrasonic vibration by receiving currents or voltages from the battery 600 of the main body 20 through the electrical terminal 500. In addition, the vibrator may be electrically connected to the processor 700 of the main body 20 through the electrical terminal 500, and the processor 700 may control the operation of the vibrator.

The electrical terminal 500 may be, for example, at least one of a Pogo PIN, a wire, a cable, a printed circuit board (PCB), a flexible printed circuit board (FPCB) and a C-clip, but the electrical terminal 500 is not limited to the above examples.

According to one or more embodiments, the atomizer 400 may be a heater that heats the aerosol generating material and generates the aerosol. According to an embodiment, the heater may be an electrical resistance heater. For example, the heater may include an electrically conductive track, and the heater may be heated when currents flow through the electrically conductive track.

The heater may include a tube-type heating element, a plate-type heating element, a needle-type heating element, or a rod-type heating element, and may heat the inside or the outside of the aerosol generating article, according to the shape of the heating element.

According to another embodiment, the heater may be an induction heater that heats the aerosol generating material by an induction heating method. The induction heater may include a susceptor and a coil. The coil may apply a magnetic field to the susceptor. The susceptor may be a magnetic substance that emits heat in response to an external magnetic field. The susceptor may be located near the coil and may be heated by a magnetic field applied to the susceptor.

In another embodiment (not shown), the atomizer 400 may be implemented as a mesh shape or plate shape vibration accommodation portion that performs a function of absorbing the aerosol generating material without using a separate wick 300 and maintaining the aerosol generating material in an optimal state for conversion to an aerosol, and a function of transmitting vibration to the aerosol generating material and generating an aerosol.

The aerosol generated by the atomizer 400 may be discharged to the outside of the cartridge 10 through an airflow passage 150 and supplied to the user.

According to an embodiment, the airflow passage 150 may be located inside the cartridge 10 and may be connected to the atomizer 400 and the outlet 160*e* of the mouthpiece 160. Accordingly, the aerosol generated in the atomizer 400 may flow along the airflow passage 150 and may be discharged to the outside of the cartridge 10 or the aerosol generating device 1000 through the outlet 160*e*. The user may be supplied with the aerosol by contacting the mouth with the mouthpiece 160 and inhaling the aerosol being discharged from the outlet 160*e*.

Although not shown in the drawing, the airflow passage 150 may include at least one inlet for air outside of the cartridge 10 to flow into the cartridge 10. The inlet may be located in at least a portion of the housing 100 of the cartridge 10. For example, the inlet may be located at the coupling surface (e.g., a bottom) of the cartridge 10 where the cartridge 10 is coupled to the main body 20.

Because at least one gap may be formed in a portion where the cartridge 10 is coupled to the main body 20, external air may flow into the gap between the cartridge 10 and the main body 20 and move into the cartridge 10 through the inlet.

The airflow passage 150 may extend from the inlet to a space where aerosol is generated by the atomizer 400, and may extend from the space to the outlet 160*e*.

Accordingly, the air flown in through the inlet may be transmitted to the atomizer 400, and the transmitted air may move to the outlet 160*e* together with the aerosol generated by the atomizer 400, and thus, airflow may be circulated inside the cartridge 10.

According to an embodiment, an outer circumferential surface of at least a portion of the airflow passage 150 may be surrounded by the storage 200 inside the housing 100. In another example, at least a portion of the airflow passage 150 may be arranged between the inner wall of the housing 100 and the outer wall of the storage 200. The arrangement structure of the airflow passage 150 is not limited to the above example, and the airflow passage 150 may be arranged in various structures in which the airflow is circulated between the inlet, the atomizer 400, and the outlet 160*e*.

The battery 600 and the processor 700 may be included inside the main body 20, and one end of the main body 20 may be coupled to one end of the cartridge 10. For example, the main body 20 may be coupled to the bottom or the coupling surface of the cartridge 10.

The battery 600 may supply power to be used for the aerosol generating device 1000 to operate. For example, when the main body 20 is electrically connected to the cartridge 10, the battery 600 may supply power to the atomizer 400.

Further, the battery 600 may supply power for operations of other hardware components provided inside the aerosol generating device 1000 (e.g., a sensor, a user interface, a memory, and the processor 700). The battery 600 may include a rechargeable battery or a disposable battery.

For example, the battery 600 may include a nickel-based battery (for example, a nickel-metal hydride battery or a nickel-cadmium battery), or a lithium-based battery (for example, a lithium-cobalt battery, a lithium-phosphate battery, a lithium titanate battery, a lithium-ion battery, or a lithium-polymer battery).

The processor 700 may generally control operations of the aerosol generating device 1000. For example, the processor 700 may control power supplied from the battery 600 to the atomizer 400 to control the production amount of the aerosol generated by the atomizer 400. According to an embodiment, the processor 700 may control the current or voltage supplied to the atomizer so that the atomizer 400 may vibrate at a certain frequency.

The processor 700 may be implemented as an array of a plurality of logic gates or as a combination of a general-purpose microprocessor and a memory in which a program executable in the microprocessor is stored. It will be understood by one of ordinary skill in the art that the processor 700 may be implemented in other forms of hardware.

The processor 700 may analyze the results sensed by at least one sensor included in the aerosol generating device 1000 and controls the processes to be performed. For example, on the basis of the result sensed by the at least one sensor, the processor 700 may control power supplied to the atomizer 400 so that operation of the atomizer 400 starts or ends. In addition, based on the result sensed by the at least one sensor, the processor 700 may control the amount of power supplied to the atomizer 400 and the time at which the power is supplied so that the atomizer 400 may generate an appropriate amount of aerosol.

According to an embodiment, the cross-sectional shape in a direction transverse to the longitudinal direction of the cartridge 10 and/or the main body 20 of the aerosol generating device 1000 may be circular, elliptical, square, rectangular, or other various types of polygons. However, the cross-sectional shape of the cartridge 10 and/or the main body 20 does not necessarily need to be limited to the shape described above, or the aerosol generating apparatus 1000 does not necessarily need to extend in a straight line in the longitudinal direction.

In another embodiment, the cross-sectional shape of the aerosol generating apparatus 1000 may be curved in a streamline shape for the user to comfortably hold the aerosol generating apparatus 1000 or may be bent in a predetermined angle at a certain area and elongated, and the cross-sectional shape of the aerosol generating apparatus 1000 may change along the longitudinal direction.

FIG. 2 is a perspective view of the cartridge and the main body of the aerosol generating device according to another embodiment, separated from each other, and FIG. 3 is a perspective view of the main body and the cartridge of the aerosol generating device according to the embodiment of FIG. 2, coupled to each other. FIG. 4 is a diagram showing an aspect of the cartridge according to the embodiment of FIG. 2, and FIG. 5 is a diagram showing another aspect of the cartridge according to the embodiment of FIG. 2.

The aerosol generating device 1 according to the embodiment shown in FIGS. 2 and 3 may be a modified example of the aerosol generating device 1000 shown in FIG. 1, and the cartridge 10 according to the embodiment shown in FIGS. 2 to 5 may be a modified example of the cartridge 10 shown in FIG. 1. Hereinafter, redundant descriptions are omitted.

Referring to FIGS. 2 and 3, the aerosol generating device 1 according to another embodiment may include the main body 20 and the cartridge 10. The cartridge 10 may be detachably coupled to the main body 20. For example, because at least a portion of the cartridge 10 is inserted into the main body 20, the cartridge 10 may be coupled to the main body 20.

The cartridge 10 may include a mouthpiece 10*m* movable between the open position and the closed position. For example, the mouthpiece 10*m* may be opened and closed by rotating between the open position and the closed position.

Referring to FIGS. 4 and 5, a body portion 10*b* of the cartridge 10 may be coupled to the mouthpiece 10*m* through a rotation shaft. According to an aspect, the mouthpiece 10*m* may be located at an open position. The open state of the mouthpiece 10*m* may indicate a state in which the mouthpiece 10*m* is spread in a longitudinal direction of the cartridge 10 for the user to easily contact the aerosol generating device to one's mouth. Here, the longitudinal direction may indicate the direction in which the cartridge 10 extends the longest among several directions.

In another aspect, the mouthpiece 10*m* may be located in the closed position. The state in which the mouthpiece 10*m* is closed may indicate that the mouthpiece is folded in a direction crossing the longitudinal direction of the cartridge 10 such that the mouthpiece 10*m* may be accommodated in the main body 20 of the aerosol generating device 1.

As another example, the mouthpiece 10*m* may be opened and closed by sliding between the open position and the closed position, but the movement method of the mouthpiece 10*m* is not limited thereto.

The cartridge 10 may include the body portion 10*b* including a variety of components required to generate aerosol and discharge the generated aerosol. Although not shown, the body part 10*b* may include a part of the storage (not shown), the atomizer (not shown), and the airflow passage (not shown). According to an embodiment, the atomizer may be located outside (e.g., the main body 20) of the cartridge 10.

The main body 20 may include a coupling portion 20*a* to which the cartridge 10 may be coupled. For example, the main body 20 may include an accommodating groove 20*a*-1 in which at least a portion of the cartridge 10 may be accommodated. The body portion 10*b* of the cartridge 10 may be inserted into the accommodating groove 20*a*-1. For example, the body portion 10*b* of the cartridge 10 may be roughly a square pillar shape, and the corners of the square pillar may be chamfered or rounded. However, the shape of the body portion 10*b* of the cartridge 10 is not limited to the above-described example and may be a circular cylinder or a polygonal pillar shape.

As described in FIG. 1, the cartridge 10 may be coupled to the main body 20 by at least one method of a snap-fit method, a screw connection method, a magnetic coupling method, or a forcible fit method. For example, the cartridge 10 may include a first magnetic body, and the main body 20 may include a second magnetic body so that the cartridge 10 may be coupled to the main body 20. However, the intensity of the first magnetic body and the second magnetic body may be designed in consideration of ease of attachment and detachment of the cartridge 10 and the main body 20 and/or the operational stability of the aerosol generating device 1.

The main body 20 may include a button 20*b*. The button 20*b* may be located on one side of the main body 20. For example, the button 20*b* may be located on one side of the main body 20 corresponding to one end 20*c*-1 of a cover 20*c*. The user may manipulate the operation of the aerosol generating device 1 by using the button 20*b* when using the aerosol generating device 1.

The main body 20 may further include an accommodation unit 20*s* that may accommodate the mouthpiece 10*m* when the mouthpiece 10*m* of the cartridge 10 is moved to the closed position. The accommodation unit 20*s* may be located on a surface of the main body 20 and may have a shape or size corresponding to the mouthpiece 10*m*.

As shown in FIG. 3, the portability of the aerosol generating device 1 may be improved because a portion of the mouthpiece 10*m* protruding from the closed position to the outside of the aerosol generating device 1, that is, the portion protruding from the outer surface of the main body 20 to the outside, may be minimized.

According to an embodiment, the main body 20 may further include the cover 20*c* that is coupled to a portion of the main body 20. The cover 20C may be coupled to at least one surface of the main body 20. For example, the cover 20*c* may be coupled to a side of the main body 20 where the coupling portion 20*a* is located. In addition, the cover 20*c* may be coupled to a side of the main body 20 where the accommodation unit 20*s* is located.

The cover 20*c* may include an opening 20*c-o*. The cover 20*c* may have an opening 20*c-o* having a size corresponding to that of the mouthpiece 10*m*. For example, the opening 20*c-o* may have a certain length and width. Here, the width of the opening 20*c-o* may be less than or equal to that of the body of the cartridge 10, and may be greater than or equal to that of the mouthpiece 10*m*. The length of the opening 20*c-o* may be greater than or equal to that of the mouthpiece 10*m*.

The cover 20*c* may extend from an end 20*c*-1 to the other end 20*c*-2 and may be placed in the seating portion 20*c*' of the main body 20. For example, the seating portion 20*c*' may have the size and shape corresponding to those of the cover 20*c*. The seating portion 20*c*' may extend in both directions of the opening portion of the coupling portion 20*a* and the accommodation unit 20*s* and may be concave in a certain depth such that the cover 20C may be coupled to the seating portion 20*c*'.

When the cartridge 10 is coupled to the main body 20, the cover 20*c* may be coupled to the main body 20 after the cartridge 10 is coupled to the main body 20. The cover 20*c* may be coupled to a side of the main body 20 by at least one method of a snap-fit method, a forcible fit method, or a magnetic coupling method, but is not limited thereto.

Because the cover 20*c* includes the opening 20*c-o* through which the mouthpiece 10*m* may pass, the cover 20*c* may protect the cartridge 10 without disturbing the opening and closing movement of the mouthpiece 10*m* of the in a state in which the cartridge 10 is coupled to the main body 20 and may maintain the state in which the cartridge 10 is coupled to the main body 20.

FIG. 3 shows an aerosol generating device 1 in which the cartridge 10 and the cover 20*c* is coupled to the main body 20 and the mouthpiece 10*m* is located at the closed position. As shown, because the main body 20 includes the accommodation unit 20*s* corresponding to the mouthpiece 10*m* in size and shape and the seating portion 20*c*' corresponding to the cover 20*c* in size and shape, and the cover 20*c* includes the opening 20*c-o* corresponding to the mouthpiece 10*m* in size and shape, the aerosol generating device 1 may be solidly and elegantly finished overall.

When the cartridge 10 is separated from the main body 20, the cartridge 10 may be separated from the main body 20 after the cover 20*c* is separated from the main body 20. In this regard, the cover 20*c* and the cartridge 10 may be sequentially separated from the main body 20 or may be sequentially coupled to the main body 20.

FIG. 6 is a cross-sectional view of the aerosol generating device of the embodiment of FIG. 2, and FIG. 7 is an exploded perspective view of the cartridge for the embodiment of FIG. 2.

The aerosol generating device 1 shown in FIG. 7 may be the aerosol generating device 1 of FIG. 2 or a modified example, and the cartridge 10 of the embodiment shown in FIGS. 6 and 7 may be the cartridge 10 of the aerosol generating device 1 of FIG. 2 or a modified example. Hereinafter, overlapping descriptions are omitted.

Referring to FIGS. 6 and 7, the aerosol generating device 1 according to another embodiment may include the cartridge 10 and the main body 20. The cartridge 10 according to an embodiment may include the mouthpiece 10*m* and the body portion 10*b*, and the main body 20 according to an embodiment may include the coupling portion 20*a* and a holding portion 20*m*.

The body portion 10*b* may include the housing 100, the storage 200, the wick 300, the atomizer 400, and a first airflow passage 150-1, and the mouthpiece 10*m* may include a second airflow passage 150-2.

The mouthpiece 10*m* may be coupled or connected to the body portion 10*b* to be movable with respect to the body portion 10*b*. The components of the cartridge 10 according to an embodiment are not limited to the examples described above, and elements may be added or some elements may be omitted.

The housing 100 may form the overall outer shape of the cartridge 10, and form an internal space in which the components of the cartridge 10 may be arranged. Although embodiments in which the overall shape of the housing 100 of the cartridge 10 is a square column were illustrated in the drawings, the shape of the housing 100 is not limited thereto. In another embodiment (not shown), the housing 100 may be formed in a cylindrical shape, or a polygonal column (e.g., a triangular column, a pentagonal column) shape other than a square column, overall.

According to one embodiment, the housing 100 may include a first housing 110, a second housing connected to an area of the first housing 110, and a third housing 130 connected to another area of the first housing 110.

For example, the second housing 120 may be coupled to an area located in the lower end (e.g. −z direction) of the first housing 110, and an inner space in which the components of the cartridge 10 may be located may be formed between the first housing 110 and the second housing 120.

The third housing 130 may be coupled to an area located at the upper end (e.g. +z direction) of the first housing 110 and at least a portion of the mouthpiece 10*m* may be disposed on a side of the third housing 130.

In the disclosure, "upper end" may refer to the "+z" direction of FIGS. 6 and 7, and "lower end" may refer to the opposite direction, the "−z" direction of FIGS. 6 and 7, and the expressions may be used as the same meaning here below.

The first housing 110 and the second housing 120 may, by being coupled to each other, form the first airflow passage 150-1 in which airflow (e.g., air, aerosol) moves inside the body portion 10*b*. For example, the first housing 110 may form a portion of the first airflow passage 150-1, and the second housing 120 may form the rest of the first airflow passage 150-1.

In addition, the first housing 110 and the second housing 120 may be coupled to each other to form an inner space, and a variety of components such as the atomizer 400, the wick 300, a circuit board 510, etc. required for the operation of cartridge 10 may be accommodated or arranged in the inner space.

The first housing 110 and the second housing 120 may protect the components accommodated in the inner space, and the third housing 130 may protect the mouthpiece 10*m* and other components that are coupled or connected to the mouthpiece 10*m*.

The housing 100 may include at least one inlet 10*i* through which the external air of the cartridge 10 may be introduced into the cartridge 10. When the user puts his/her mouth to the mouthpiece 10*m* and inhales, the pressure inside the cartridge 10 may become lower than the atmospheric pressure, and the external air may be introduced into the cartridge 10 through the inlet 10*i*.

The housing 100 may form at least a portion of the first airflow passage 150-1, or some structure of the housing 100 may function as an inner wall of the first airflow passage 150-1. For example, the first housing 110 may be in communication with the atomizer 400, and may include an atomizing space 400*c* from which aerosol is generated and a connector 110*c* connecting the body portion 10*b* and the mouthpiece 10*m*. The atomizing space 400*c* may be located at a center of the first housing 110, and the connector 110*c* may be located on the top surface of the first housing 110 where the first housing 110 is coupled to the third housing 130.

According to an embodiment, the second housing 120 may include an inlet 10*i*. The inlet 10*i* may be formed in at least a portion of the second housing 120. For example, the inlet 10*i* may be located at the bottom surface of the second housing 120 where the cartridge 10 is coupled to the main body 20.

The mouthpiece 10*m* is where the user's mouth may be in contact, and the mouthpiece 10*m* may be placed or coupled to an area of the housing 100. For example, the mouthpiece 10*m* may be connected to the third housing 130.

The mouthpiece 10*m* may be may move between the open position and the closed position. The cartridge 10 may further comprise a first elastic body 10*m*-1 that provides elastic force to the mouthpiece 10*m*. For example, the first elastic body 10*m*-1 may elastically support the mouthpiece 10*m* toward the open position.

The first elastic body 10*m*-1 may be located around the rotation shaft of the mouthpiece 10*m*. The mouthpiece 10*m* may move from the closed position to the open position by the elastic force of the first elastic body 10*m*-1. The first elastic body 10*m*-1 may be made of a metal material (e.g., SUS).

According to an embodiment, the mouthpiece 10*m* may rotate around the rotation shaft, and the first elastic body 10*m*-1 may be a torsion spring located at the rotation shaft of the mouthpiece 10*m*. The deformation of the first elastic body 10*m*-1 may be relatively large when the mouthpiece 10*m* is in the closed position, and the deformation of the first elastic body 10*m*-1 may be relatively small when the mouthpiece 10*m* is in the open position. Accordingly, the mouthpiece 10*m* may be provided with elastic power that is biased such that the mouthpiece 10 opens from the closed position to the open position.

The mouthpiece 10*m* may include the second airflow passage 150-2 for discharging the aerosol generated from the inside of the cartridge 10 to the outside of the cartridge 10. For example, one end (e.g., the outlet 10*e*) of the second air flow passage 150-2 may be connected to the outside and the other end may be connected to the first airflow passage 150-1 in the open position. The user may put his/her mouth to the mouthpiece 10*m* and be provided with the aerosol that is discharged to the outside through the outlet 10*e* of the mouthpiece 10*m*.

According to an embodiment, the mouthpiece 10*m* may be rotatably coupled to the third housing 130 together with a support portion 10*m*-2. The support portion 10*m*-2 may be located between the mouthpiece 10*m* and the third housing 130, and may cover at least a portion of the other side of the mouthpiece 10*m*.

The mouthpiece 10*m*, the support portion 10*m*-2, and the third housing 130 may be connected to each other by the rotation shaft. Accordingly, the mouthpiece 10*m* may not only be firmly coupled to the third housing 130, but is also rotatable with respect to the third housing 130 and thus, may move between the open position and the closed position.

The mouthpiece 10*m* may be held in the closed position by the holding portion 20*m* of the main body 20. Details of the holding portion 20*m* are described below.

The aerosol generated by the atomizer 400 may be discharged to the outside of the cartridge 10 through the airflow passage 150 and supplied to the user. For example, aerosol generated by the atomizer 400 may flow along the airflow passage 150 that connects or puts the atomizing space 400*c* to or in communication with the outlet 10*e* of the mouthpiece 10*m*, and may be discharged to the outside of the cartridge 10 through the airflow passage 10*e*.

According to an embodiment, the airflow passage 150 may extend along the inlet 10*i*, the atomizing space 400*c* in which aerosol is generated, and the outlet 10*e*. The airflow passage 150 may be formed by at least one component (e.g., the first housing 110, the second housing 120, and the mouthpiece 10*m*) of the cartridge 10. Alternatively, a change may be made to the above design so that at least a portion of the airflow passage 150 may be formed by a tube inserted into the housing 100.

Air may pass through the atomizing space 400*c* from the inlet 10*i* and flow in a forward direction towards the outlet 10*e*. Herein, "forward direction" may indicate the direction of the airflow when the user inhales through the mouthpiece 10*m*. For example, the forward direction may indicate a direction towards the atomizing space 400*c* from the inlet 10*in* and a direction towards the outlet 10*e* from the atomizing space 400*c*.

According to an embodiment, the airflow passage 150 may include the first airflow passage 150-1 which is connected from the inlet 10*i* through the atomizing space 400*c* to the connector 110*c* to which the body portion 10*b* and the mouthpiece 10*m* are connected, and a second airflow passage 150-2 located inside the mouthpiece 10*m*.

The first airflow passage 150-1 may be connected from the inlet 10*i* through the inner structure of the first housing 120 and the second housing 110 to the connector 110*c*. For example, the airflow moving in the forward direction along the first airflow passage 150-1 may move in the +z direction, a direction across the z axis, the −z direction, the direction across the z axis, and the +z direction, sequentially.

Referring to FIGS. 6, the first airflow passage 150-1 may indicate a space in which external air flown into the cartridge 10 through the inlet 10*i* is flown into the atomizing space and is flown together with the aerosol to the connector 110*c*. According to the example above, the first airflow passage 150-1 may roughly have a 'S' shape.

The airflow flowing in the first airflow passage 150-1 may form a sudden curve in a portion where the flowing direction changes. For example, the flowing path of the airflow may be suddenly changed in a portion where the atomizing space 400*c* is placed. For this reason, the time the airflow stays in the atomizing space 400*c* and the possibility of occurrence of eddy currents may increase. As a result, the external air flown into the atomizing space 400*c* and the generated aerosol may be more easily mixed.

The second airflow passage 150-2 may indicate the internal passage of the mouthpiece 10*m*. The second airflow passage 150-2 may be connected to the connector 110*c* when the mouthpiece 10*m* is in the open position. The second airflow passage 150-2 may be disconnected from the connector 110*c* when the mouthpiece 10*m* is in the closed position.

The storage 200 may be arranged in the inner space of the first housing 110, and the aerosol generating material may be stored in the storage 200. For example, a liquid aerosol generating material may be stored in the storage 200, but embodiments are not limited thereto.

The wick 300 may be located between the storage 200 and the atomizer 400, and the aerosol generating material stored in the storage 200 may be supplied to the atomizer 400 through the wick 300.

According to an embodiment, the wick 300 may receive the aerosol generating material from the storage 200, and may deliver the received aerosol generating material to the atomizer 400. For example, the wick 300 may absorb the aerosol generating material of the storage 200, and the aerosol generating material absorbed by the wick 300 may be delivered to the atomizer 400 side.

The wick 300 may be arranged adjacent to the storage 200 to receive the liquid aerosol generating material from the storage 200. For example, aerosol generating material stored in the storage 200 may be discharged to the outside of the storage 200 through a liquid supply port (not shown) that is formed in an area facing the wick 300 from the storage 200, and the wick 300 may absorb at least some of the aerosol generating material discharged from the storage 200, thereby absorbing the aerosol generating material from the storage 200.

According to an embodiment, the cartridge 10 may be arranged to cover at least a portion of the atomizer 400 in which the aerosol is generated, and may further include an absorbent 320 that delivers the aerosol generating material absorbed by the wick 300 to the atomizer 400.

The absorbent 320 may be an absorbing plate, which is manufactured with a material that can absorb aerosol generating materials. For example, the absorbent 320 may include at least one material from among SPL 30 (H), SPL 50 (H) V, NP 100 (V8), SPL 60 (FC), and melamine.

Because the absorbent 320 is further included in the cartridge 10, the aerosol generating material may be absorbed not only in the wick 300 but also in the absorbent 320, thereby improving the aerosol generating material absorption amount.

In addition, because the absorbent 320 is arranged to cover at least a portion of the atomizer 400, the absorbent 320 may act as a physical barrier that prevents a "splash of droplets," which is a direct discharging of particles that are not sufficiently atomized in the process of generating aerosol to the outside of the aerosol generating device 1. Herein, the "splash of droplets" may mean that particles of aerosol generating materials that are relatively greater in size due to not having not been sufficiently atomized are discharged to the outside of the cartridge 10. Because the absorbent 320 is further included in the cartridge 10, the likelihood of the splashing of droplets may be reduced and thus, the smoking satisfaction of the user may be improved.

According to an embodiment, the absorbent 320 may be located between a surface of the atomizer 400 in which the aerosol is generated and the wick 300, thereby delivering the aerosol supplied to the wick 300 to the atomizer 400. For example, an area of the absorbent 320 may be in contact with an area facing the −z direction of the wick 300, and the other region of the absorbent 320 may be in contact with an area facing the +z direction of the atomizer 400. Thus, the absorbent 320 may be located at the top surface (e.g., +z direction) of the atomizer 400, and may supply the aerosol generating material absorbed by the wick 300 to the atomizer 400.

The wick 300, the absorbent 320, and the atomizer 400 may be disposed sequentially along the longitudinal direction (e.g., z axis direction) of the cartridge 10 or the housing 100, and, as a result, the absorbent 320 and the wick 300 may be sequentially stacked on the atomizer 400.

Through the arrangement structure described above, at least some of the aerosol generating material supplied from the storage 200 to the wick 300 may be moved to the absorber 320 in contact with the wick 300, and the aerosol generating material moved to the absorbent 320 may move along the absorbent 320 to reach an area adjacent to the atomizer 400. Accordingly, the aerosol generating material is stably delivered to the atomizer 400, and thus, a uniform amount of aerosol may be generated continuously, and a physical double barrier that prevents the splash of droplets may be implemented through the arrangement structure described above by using the wick 300 and the absorber 320.

The drawings show embodiments in which only one wick 300 and absorbent 320 each are included, but the cartridge 10 according to another embodiment may include two or more of any one of the wick 300 and the absorbent 320.

The atomizer 400 may atomize the liquid aerosol generating material supplied from the wick 300 to generate an aerosol.

For example, the atomizer 400 may include an atomizer that generates ultrasonic vibration. The frequency of ultrasonic vibration generated in the vibrator may be about 100 kHz to about 10 MHz, for example, about 100 kHz to about 3.5 MHz. As the vibrator generates ultrasonic vibration in the frequency band described above, the vibrator may vibrate along the longitudinal direction (e.g., z direction) of the cartridge 10 or the housing 100. However, the embodiments are not limited to the direction in which the vibrator vibrates, and the direction in which the vibrator vibrates may be changed to various directions (e.g., any one of the x axis direction, y axis direction, z axis direction, or a combination of the directions).

The atomizer 400 may generate an aerosol at a relatively low temperature compared to when the aerosol generating material is heated by atomizing the aerosol generating material through an ultrasonic vibration method. For example, in the case of heating the aerosol generating material by using the heater, a situation in which the aerosol generating material is heated to a temperature of 200° C. or more may occur, causing the user to feel a burnt taste in the aerosol.

On the other hand, the cartridge 10 according to an embodiment may generate aerosol in a temperature range of about 100° C. to about 160° C., which is a temperature lower than when the aerosol generating material is heated with the heater, by atomizing the aerosol generating material through the ultrasonic vibration method. Accordingly, the burnt taste in the aerosol may be minimized, thereby improving the smoking satisfaction of the user.

The atomizer 400 may be electrically connected to an external power through the circuit board 510, and may generate ultrasonic vibration by the power supplied from the external power. For example, the atomizer 400 may be electrically connected to the circuit board 510 located inside the cartridge 10, and the circuit board 510 may be electrically connected to the main body 20, and thus, the atomizer 400 may be supplied with power from the battery 600.

Aerosol may be generated in the atomizing space 400*c* located on a surface of the atomizer 400 and in communication with the airflow passage 150. When the user inhales through the open mouthpiece 10*m*, the aerosol generated in the atomizing space 400*c* may be mixed with the external air flown in along the airflow passage 150 and move toward the outlet 10*e*.

In an example, the atomizing space 400*c* may be located at a surface of the atomizer 400 facing the connection 110*c*, and the atomizing space 400*c* may be in communication with the airflow passage 150 at the upper end of the atomizer 400. Accordingly, because the cartridge 10 has a straight aerosol discharging path, the generated aerosol may easily be discharged to the outside of the cartridge 10.

According to an embodiment, the atomizer 400 may be electrically connected to the circuit board 510 through a first conductor 410 and a second conductor 420.

According to an embodiment, the first conductor 410 may include a material (e.g., metal) having electrical conductivity, and may be located at the upper end of the atomizer 400, thereby electrically connecting the atomizer 400 and the circuit board 510.

For example, a portion of the first conductor 410 (e.g., the upper end portion) may be arranged to cover at least an area of the outer circumferential surface of the atomizer 400 to be in contact with the atomizer 400, and the other portion (e.g., the lower end portion) of the first conductor 410 may be formed to extend from a portion toward a direction of the circuit board 510 to be in contact with an area of the circuit board 510. The atomizer 400 and the circuit board 510 may be electrically connected by the contact structure of the first conductor 410 described above.

For example, because an opening 410*h* is formed on a portion of the first conductor 410, at least a portion of the atomizer 400 may be exposed to the outside of the first conductor 410. An area of the atomizer 400 exposed to the outside of the first conductor 410 through the opening 410*h* of the first conductor 410 is may be in contact with the wick 300 and/or the absorbent 320 to atomize the aerosol generating material contained in the wick 300 and/or the absorbent 320.

According to an embodiment, the second conductor 420 may include a material having electrical conductivity, and may be located at the lower end of the atomizer 400 or between the atomizer 400 and the circuit board 510, thereby electrically connecting the atomizer 400 and the circuit board 510. For example, the second conductor 420 may be in contact with the lower end portion of the atomizer 400, and the other end may be in contact with an area of the circuit board 510 facing the atomizer 400, thereby electrically connecting the atomizer 400 and the circuit board 510.

According to an embodiment, the second conductor 420 may include a conductive material having an elasticity, thereby electrically connecting the atomizer 400 to the circuit board 510, in addition to elastically supporting the atomizer 400. For example, the second conductor 420 may include a conductive spring, but the second conductor 420 is not limited to the embodiment described above.

The cartridge 10 according to an embodiment may include a support 430 located between the atomizer 400 and the circuit board 510, thereby supporting the second conductor 420. The support 430 may include, for example, an elastic material (e.g., silicon and rubber), and may be arranged to cover the outer circumferential surface of the second conductor 420 to elastically support the second conductor 420. Embodiments related to the cartridge 10 are not limited by the structure of the support, the support 430 may be omitted in some embodiments.

According to an embodiment, the circuit board 510 may be located inside the second housing 120 and may be electrically connected to the atomizer 400 through the first conductor 410 and the second conductor 420. At the same time, the circuit board may be electrically connected to the main body 20 through a connection terminal 20*a*-2 located in the main body 20 of the aerosol generating device 1.

The circuit board 510 may be electrically connected to the atomizer 400 by the first conductor 410 and the second conductor 420, and may be electrically connected to the battery 600 of the main body 20 through the connection terminal 20*a*-2, and thus, the atomizer 400 may be electrically connected to the external power of the cartridge 10 through the circuit board 510 to be supplied with power.

According to an embodiment, the second housing 120 may include a through hole 120*h* penetrating through the inside of the second housing 120 and the outside of the cartridge 10, and the connection terminal 20*a*-2 of the main body 20 of the aerosol generating device 1 may be connected to the second housing 120 through the through hole 120*h*, thereby electrically connecting the circuit board 510 located inside the cartridge 10 and the battery 600 of the main body 20.

The cartridge 10 may further include a support plate 510 for grounding the circuit board 510 or firmly coupling the circuit board 510 to the second housing 120. The support plate 510 may be located between the second housing 120 and the circuit board 510 to reinforce the coupling between the circuit board 510 and the second housing 120. In addition, the support plate 510 may include hole corresponding to the through hole such that the connection terminal 20*a*-2 of the main body 20 may be connected to the inside of the cartridge 10.

When power starts to be supplied to the atomizer 400, or during the process of supplying power to the atomizer 400, noise may unintentionally occur in an electrical circuit between the atomizer 400 and the external power source. For example, a higher voltage than a designated value may be applied to the atomizer 400 due to the generation of noise in the voltage signal provided to the atomizer 400, and thus, the temperature of the atomizer 400 may rise sharply (e.g., rise above the Curie temperature), thereby damaging the atomizer 400.

According to an embodiment, the cartridge 10 may further include a resistor R for removing the noise included in the signal applied to the atomizer 400. For example, the resistor R for removing or filtering the noise generated in the process of supplying power from the external power to the atomizer 400 may be arranged in the an area of the circuit board 510.

The circuit board 510 may be a printed circuit board, and the resistor R may be mounted in an area of the printed circuit board. Accordingly, the resistor R may remove the noise generated when the aerosol generating device 1 operates (or "power on"), thereby allowing a stable voltage to be applied to the atomizer 400.

Herein, "the resistor R is mounted on an area of the printed circuit board" may refer to, for example, a surface mount method in which the resistor R is electrically connected to the printed circuit board in such a way that it protrudes from the surface of the printed circuit board, or to a method in which the resistor R is installed such that at least a portion of the resistor R is buried in a surface of the printed circuit board.

The cartridge 10 according to an embodiment may remove or filter the noise generated from the electrical circuit formed between the atomizer 400 and the external power through the resistor R, and as a result, the cartridge 10 or the aerosol generating device 1 may operate stably.

According to an embodiment, the resistor R may form a feedback circuit connected in parallel to the atomizer 400. The resistor R may allow a stable voltage to be applied to the atomizer 400 by removing the noise included in the voltage signal applied to the atomizer 400 by forming the feedback circuit. As a result, damage to the atomizer 400 due to the noise may be prevented, thereby enabling a stable operation of the cartridge 10 or the aerosol generating device 1.

According to an embodiment, the circuit board 510 may be arranged inside the cartridge 10 to be adjacent to the atomizer 400, and the resistor R may be arranged or mounted on a first surface of the circuit board 510 facing the atomizer 400.

When the resistor R for removing the noise included in the voltage signal applied to the atomizer 400 is arranged on a second surface of the circuit board 510, or on the main body 20 instead of the cartridge 10, the electrical length of the feedback circuit may increase.

When the electrical length of the feedback circuit increases, noise may additionally occur during a feedback process of the voltage signal applied to the atomizer 400, and thus, a voltage signal including the noise may be applied to the atomizer 400 even when the feedback circuit is formed.

On the other hand, in the cartridge 10 according to an embodiment, because the circuit board 510 is arranged in a within a designated distance from the atomizer 400, and the resistor R forming the feedback circuit is arranged on the top surface of the circuit board 500 adjacent to the atomizer 400, the electrical length of the feedback circuit may decrease. Here, "the designated distance between the circuit board 510 and the atomizer 400" may refer to a distance to prevent noise from occurring during the feedback process of the voltage signal.

As a result, a stable voltage signal may be provided to the atomizer 400 by preventing additional noise from occurring during a feedback process of the voltage signal applied to the atomizer 400.

Thus, in the cartridge 10 according to an embodiment, because the resistor R is arranged inside the cartridge 10 instead of the main body 20, stable voltage may be provided to the atomizer 400, and as a result, prevention of damage to the atomizer 400 and a stable operation of the cartridge 10 or aerosol generating device 1 may be guaranteed.

The resistor R may be formed to have a resistance value of about 0.8 MΩ to about 1.2 MΩ to eliminate noise included in the voltage signal applied to the atomizer 400. However, the resistance value of the resistor R may be altered according to the embodiment.

Because at least a portion of the airflow passage 150 is arranged to be covered by the storage 200, the aerosol generating material being leaked from the storage 200 may flow into the airflow passage 150, thereby decreasing the user's smoking satisfaction.

The cartridge 10 according to an embodiment may further include a hollow portion 210 for preventing the aerosol generating material from leaking from the storage 200 and flowing into the airflow passage 150.

The hollow portion 210 may seal the gaps around the liquid supply port of the storage 200 (e.g., a gap between the liquid supply port and the wick 300). Accordingly, because the hollow portion 210 blocks the aerosol generating material of the storage 200 from leaking into the airflow passage 150 in the cartridge 10 according to an embodiment, the user's smoking satisfaction may be prevented from decreasing.

According to an embodiment, the hollow portion 210 may be located in the atomizing space 400*c* of the housing 100 to prevent the aerosol generating material of the storage 200 from leaking into the airflow passage 150. For example, the hollow portion 210 may have a circular hollow shape. The hollow portion 210 may be fitted inside the first housing 110 and may be in close contact with the outer wall of the storage 200 and the inner wall of the first airflow passage 150-1.

Because the hollow portion 210 has a passage portion therein, the aerosol generating material may be prevented from flowing into of the airflow passage 150 from the storage 200 and, at the same time, the hollow portion 210 may form a portion of the airflow passage 150 in which aerosol generated from the atomizer 400 moves.

According to an embodiment, the hollow portion 210 may include a plurality of holes connected to the first airflow passage 150-1. For example, the hollow portion 210 may include a first hole 211 and a second hole 212 on the top surface.

The first hole 211 of the hollow portion 210 located inside the first housing 110 may be connected to the first airflow passage 150-1. For example, the first hole 211 may be formed at a position adjacent to the outer wall of the storage 200 in the hollow portion 210, and the external air flowing in the first airflow passage 150-1 in the −z direction may move to the atomizing space 400*c* through the first hole 211.

The second hole 212 may be formed such that the aerosol generated in the atomizing space 400*c* may move to the connector 110*c*. For example, the second hole 212 may be formed in a portion of the hollow portion 210 in which the atomizing space 400*c* faces the connector 110*c*, and thus, the aerosol generated from the atomizing space 400*c* and flowing in the +z direction may move to the mouthpiece 10*m* side through the second hole 212.

The external air flown into the airflow passage 150 may move to the atomizing space 400*c* through the first hole 211, and may change its path in the atomizing space 400*c* and move to the outside of the cartridge 10 through the second hole 212.

The hollow portion 210 may include an elastic material (e.g., rubber) and thus may absorb the ultrasound vibration generated in the atomizer 400. Accordingly, the phenomenon in which the ultrasonic vibration generated by the atomizer 400 is delivered to the user through the housing 100 of the cartridge 10 may be minimized.

The hollow portion 210 may maintain a contact between the wick 300 and the atomizer 400 by being located at the upper end of the wick 300 and pressing in a direction toward the atomizer 400. For example, the hollow portion 210 may maintain a contact between the absorbent 320 and the atomizer 400 by pressing the wick 300 and/or the absorbent 320 in the −z direction.

The cartridge 10 according to an embodiment may further include a first waterproof body 330 for maintaining the wick 300 and/or the atomizer 400 inside the first housing 110.

The first waterproof body 330 may arranged to cover at least a portion of the outer circumferential surface of the wick 300, the absorbent 320, and/or the atomizer 400, thereby accommodating the wick 300, the absorbent 320, and/or atomizer 400.

According to an embodiment, the first waterproof body 330 may be disposed between the first housing 110 and the second housing 120. Accordingly, the wick 300, the absorbent 320, and/or the atomizer 400 may be maintained or fixed to an area between the first housing 110 and the second housing 120.

The first waterproof body 330 may be coupled to the first housing 110 such that at least a portion of the first waterproof body 330 is forcibly fit to the first housing 110, but the method of coupling the first housing 110 to the first waterproof body 330 is not limited thereto. In another example, the first housing 110 may be coupled to the first waterproof body 330 by at least one of a snap-fit method, a screw connection method, or a magnetic force coupling method.

According to an embodiment, the first waterproof body 330 may include a material having a certain rigidity and waterproofness (e.g., rubber), and may not only fix the wick 300 and the atomizer 400 to the first housing 110, but also prevent the aerosol generating material from leaking from the storage 200. For example, because the storage 200 seals an area adjacent to the wick 300 or the atomizer 400, the first waterproof body 330 may prevent the leakage of the aerosol generating material.

In addition, the first waterproof body 330 may include an elastic material (e.g., a rubber) like the hollow portion 210 and thus absorb the ultrasonic vibration generated in the atomizer 400.

According to an embodiment, the cartridge 10 may maintain a bond between the first housing 110 and the second housing 120 and further include an O-ring 115 for sealing a space between the first housing 110 and the second housing 120.

For example, the O-ring 115 may be located between the first housing 110 and the second housing 120, and may fill a gap where the first housing 110 is coupled to the second housing 120. Accordingly, the external air of the cartridge 10 may be prevented from flowing into the cartridge 10 through other parts other than the inlet 10*i*.

The O-ring 115 includes a material having a certain elasticity (e.g., silicone) to closely seal a space between the first housing 110 and the second housing 120.

According to an embodiment, the cartridge 10 may further comprise a first sealing body 141 for maintaining the bond between the first housing 110 and the third housing 130 and sealing the storage 200.

The first sealing body 141 may be arranged between the first housing 110 and the third housing 130. For example, the first sealing body 141 may be coupled to the upper end of the first housing 110 and coupled to the lower end of the third housing 130 to thereby maintain a firm bond between the first housing 110 and the third housing 130.

In addition, the first sealing body 141 may include a structure in which the storage 200 is sealed while the first airflow passage 150-1 is not sealed. For example, the first sealing body 141 be coupled to the upper end of the first housing 110 and have a structure in which a hole is included in a portion where the first airflow passage 150-1 is located and a hole is not included in a portion where the storage 200 is located. Accordingly, while the first sealing body 141 may separate the storage 200 and the first airflow passage 150-1 in the upper end of the first housing 110 while not blocking the first airflow passage 151-1.

The cartridge 10 may further include a second sealing body 142 that is coupled to the third housing 130 and seals the surrounding of the connector 110*c*. The second sealing body 142 may be coupled to the upper end of the third housing 130. The second sealing body 142 may include a hole having a size corresponding to that of the connector 110*c*, thereby sealing the surrounding of the portion where the first airflow passage 150-1 is connected to the second airflow passage 150-2 while not blocking the connector 110*c*.

The cartridge 10 may include both the first sealing body 141 and the second sealing body 142. The first sealing body 141 and the second sealing body 142 may be coupled to the upper and lower ends of the third housing 130, respectively, and at least a portion of the first sealing body 141 and the second sealing body 142 may be partially coupled to each other inside the third housing 130. Accordingly, the first housing 110 may be more firmly coupled to the third housing 130 via the first sealing body 141 and the second sealing body 142.

Although the first sealing body 141 and the second sealing body 142 may be coupled to the first housing 110 and/or the third housing 130 through forcible fixing, the coupling method of the first sealing body 141 and the second sealing body 142 is not limited to the embodiment described above.

The first sealing body 141 and the second sealing body 142 may include a material having a certain rigidity and waterproofness (e.g., silicon), may be firmly coupled to the first housing 110 and/or the third housing 130, and may function as a portion of the inner wall of the first airflow passage 150-1.

In the process of atomizing the aerosol generating material by the atomizer 400, some of the aerosol generating material may not be sufficiently atomized, and thus, droplets with relatively large particles may be generated. In addition, some of the atomized aerosol may be liquefied inside the airflow passage to produce droplets. The generated droplets may block the airflow passage 150, be leaked to the outside of the cartridge 10 through the inlet 10*i*, or be leaked to the outside of the mouthpiece 10*m* through the outlet 10*e*, thereby decreasing the convenience and smoking satisfaction of the user.

According to another embodiment, the cartridge 10 may further include an absorbent (not shown) for absorbing droplets generated on the airflow passage. For example, the absorbent (not shown) that absorbs droplets generated on the first airflow passage 150-1 may be arranged between the inlet 10*i* and the atomizing space 400*c*. For example, at least part of the absorbent may be located inside the housing 100 and may be connected to the first airflow passage 150-1. Accordingly, the droplets generated on the airflow passage 150 may be absorbed in the absorbent, thereby preventing the inner wall of the airflow passage 150 from being narrowed or blocked by the droplets.

The absorbent may be located between the first support 330 and the second housing 120, and may be connected to the first airflow passage 150-1 adjacent to the inlet 10*i*. Accordingly, the droplets generated in the first airflow passage 150-1 adjacent to the inlet 10*i* may be absorbed in the absorbent, thereby preventing leakage through the inlet 10*i*.

In another example, the absorbent may be located in an area where the first housing 110 is coupled to the third housing 130. Accordingly, the droplets of liquefied aerosol in an area adjacent to the first airflow passage 150-1 may be absorbed in the absorbent. As a result, droplets may be effectively removed, and the amount of leakage of the cartridge 10 may be reduced.

In another example, the absorbent may be arranged around the other side of the mouthpiece 10*m* to absorb the droplets generated on the second airflow passage 150-2. For example, the absorbent may be arranged between the third housing 130 and the support portion 10*m*-2. The absorbent may prevent the droplets generated in the airflow passage 150 from moving or flowing in a direction toward the outlet 10*e* of the mouthpiece 10*m*. As a result, leakage through the outlet 10*e* may be prevented.

The absorbent may include at least one of a felt, cotton, cloth, and activated carbon for absorption or adsorption of liquid or solid residue, but is not limited thereto.

The main body 20 according to an embodiment may include a coupling portion 20*a* and a holding portion 20*m*. The cartridge 10 may be detachably coupled to the main body 20, and the coupling portion 20*a* may be part of the main body 20 to which the cartridge 10 is coupled. The holding portion 20*m* may maintain or fix the mouthpiece 10*m* located at the closed position.

The coupling portion 20*a* may accommodate at least a portion of the cartridge 10. For example, the coupling portion 20*a* may include an accommodating groove 20*a*-1 having a shape corresponding to the body portion 10*b* so that the body portion 10*b* of the cartridge 10 may be accommodated or inserted in the coupling portion 20*a*. The cartridge 10 inserted into the accommodating groove 20*a*-1 may be coupled to the main body 20 by various coupling methods described above.

According to an embodiment, at least an area of the body portion 10*b* of the cartridge 10 may include a first magnetic body (not shown), and at least an area of the coupling portion 20*a* of the main body 20 may include a second magnetic body (not shown). For example, the first magnetic body may be arranged at the lower end of the body portion 10*b*, and the second magnetic body may be arranged at the bottom of the coupling portion 20*a* of the main body 20 that faces the lower end of the inserted body portion 10*b*. Accordingly, the cartridge 10 inserted to a certain position of the accommodating groove 20*a*-1 may be coupled to the accommodating groove 20*a*-1 by magnetic force.

According to an embodiment, the coupling portion 20*a* may include a connection terminal 20*a*-2 for electrically connecting the main body 20 and the cartridge 10. The connection terminal 20*a*-2 may be, for example, at least one of a Pogo PIN, a wire, a cable, a printed circuit board (PCB), a flexible printed circuit board (FPCB), and a C-clip, but the connection terminal 20*a*-2 is not limited to the above examples.

As described above, the connection terminal 20*a*-2 may be connected to the inside of the body portion 10*b* of the cartridge 10 through the through hole 120*h* of the cartridge 10, and may be connected to the circuit board 510 of the cartridge 10. Because the circuit board 510 of the cartridge 10 is electrically connected to the atomizer 400, the atomizer 400 may be electrically connected to the main body 20 by the connection between the connection terminal 20*a*-2 and the circuit board 510. Accordingly, the atomizer 400 may receive power from the battery 600 of the main body 20.

The aerosol generating device 1 may further include an inhalation detecting sensor S. The inhalation detecting sensor S may detect the pressure change or the flow of air inside the aerosol generating device 1, thereby sensing whether the user puffs the aerosol generating device 1.

The inhalation detecting sensor S may be located in any position of the cartridge 10 or the main body 20. Because the cartridge 10 is a consumable that may be replaced when all the aerosol generating material stored therein are consumed, it may be economic to place the inhalation detecting sensor S in the main body 20.

According to an embodiment, the inhalation detecting sensor S may be located adjacent to the coupling portion 20*a* of the main body 20. For example, the inhalation detecting sensor S may be located in an area of the coupling portion 20*a* adjacent to the outer circumferential surface of the body portion 10*b* of the cartridge 10 coupled to the main body 20. In another example, the inhalation detecting sensor S may be located at an area of the main body 20 (e.g., the accommodating groove 20*a*-1) facing the outer circumferential surface of the housing 100 of the cartridge 10 coupled to the main body 20.

Because the external air may be introduced into the aerosol generating device 1 through a fine gap between the main body 20 and the cartridge 10 that are coupled to each other, the inhalation detecting sensor S may be arranged adjacent to an area where the external air flows, and thus, the pressure change or the flow of air inside the main body 20 may be more accurately detected.

The aerosol generating device 1 may include a processor (not shown) for controlling the overall operation of the aerosol generating device 1 and a battery 600 for supplying power necessary for the operation of the aerosol generating device 1.

In addition, the aerosol generating device 1 may include an external terminal 20*u* for to be electrically connected to an external device. The external terminal 20*u* may include, for example, a USB terminal. The aerosol generating device 1 may transmit and receive power and data to and from the external device through the external terminal 20*u*.

The aerosol generating device 1 according to an embodiment may include a holding portion 20*m* for holding the mouthpiece 10*m* at a certain position. For example, the main body 20 may include a holding portion 20*m* for holding the closed mouthpiece 10*m* in the closed position. The holding portion 20*m* may be located at an end of the accommodation unit 20*s* accommodating the mouthpiece 10*m* in the closed position. For example, the holding portion 20*m* may be located adjacent to an end of the mouthpiece 10*m* stored in the accommodation unit 20*s*.

When the user closes the mouthpiece 10*m*, an external force may be applied to the mouthpiece 10*m* to move from the open position to the closed position. When the mouthpiece 10*m* moves to the closed position, the holding portion 20*m* may provide a holding force to the mouthpiece 10*m* so that the mouthpiece 10*m* is held in the closed position. For example, the holding portion 20*m* may provide magnetic force, elastic force, and/or frictional force to an end of the mouthpiece 10*m* so that the mouthpiece 10*m* is held in the closed position.

When the user opens the mouthpiece 10*m*, an external force may be applied to the mouthpiece 10*m* to move from the closed position to the open position. For example, when the user presses the other side of the mouthpiece 10*m* above a certain force, the mouthpiece 10*m* may be separated from the holding portion 20*m*, and may rotate to the open position from the closed position.

For example, an end of the holding portion 20*m* and an end of the mouthpiece 10*m* may include magnetic bodies with opposite polarity, respectively. Accordingly, when an end of the mouthpiece 10*m* becomes adjacent to the closed position by a certain distance, the mouthpiece 10*m* may be held at the closed position by being pulled by magnetic force.

In another example, the holding portion 20*m* may include a locking unit 20*m*-1 that adds a reaction force to an end of the mouthpiece 10*m*. The locking unit 20*m*-1 may add a reaction force in a direction opposite to the direction in which the mouthpiece 10*m* moves so that the mouthpiece 10*m* is not opened in the closed position.

Details on the above are described with reference to FIGS. 8A and 8B.

FIG. 8A is an enlarged view of part A in FIG. 6, and FIG. 8B is an enlarged view of a modified example of part A in FIG. 6.

Referring to FIG. 8A, the holding portion 20*m* may include the locking unit 20*m*-1 and a second elastic body 20*m*-2. The holding portion 20*m*' according to an embodiment of FIG. 8B is identical to the holding portion 20*m* according to an embodiment of FIG. 8A, except that shapes of only some parts are different.

The locking units 20*m*-1 and 20*m*-1' may be coupled to the mouthpiece 10*m* that moved to the closed position to hold the mouthpiece 10*m* in the closed position. For example, at least a portion of the locking units 20*m*-1 and 20*m*-1' may be inserted into the mouthpiece 10*m* in the closed position.

According to an embodiment, the locking units 20*m*-1 and 20*m*-1' may respectively include portions 20*m*-11 and 20*m*-11' facing the mouthpiece 10*m* and may include another portion 20*m*-12 located inside the main body 20. For example, portions 20*m*-11 and 20*m*-11' of the locking units 20*m*-1 and 20*m*-1' may be inserted into one end of the second airflow passage 150-2.

Accordingly, the locking units 20*m*-1 and 20*m*-1' may be coupled or bound to the mouthpiece 10*m* in the closed position, and may provide a holding force to one end of the mouthpiece 10*m* in a direction opposite to the direction in which the mouthpiece 10*m* opens.

The second elastic body 20*m*-2 may press the locking units 20*m*-1 and 20*m*-1' in one direction in a usual state in which external force to open the mouthpiece 10*m* is not applied to the mouthpiece 10*m*. The second elastic body 20*m*-2 may be located at the other portion 20*m*-12 of the locking units 20*m*-1 and 20*m*-1' to press the locking units 20*m*-1 and 20*m*-1' in one direction. For example, the second elastic body 20*m*-2 may be wound around the other portion 20*m*-12 of the locking units 20*m*-1 and 20*m*-1' to thereby be coupled to the locking units 20*m*-1 and 20*m*-1'.

According to one or more embodiments, portions 20*m*-11 and 20*m*-11' of the second elastic body 20*m*-2 may have a curved shape as shown in FIG. 8A or an oblique shape as shown in FIG. 8B. Accordingly, when the mouthpiece 10*m* moves from the closed position to the open position, the second elastic body 20*m*-2 may be compressed to another direction, thereby separating the holding portion 20*m* from the mouthpiece 10*m*.

For example, when external force is applied to the mouthpiece 10*m* such that the mouthpiece 10*m* moves from the closed position to the open position, the one end of the mouthpiece 10*m* may at least partially press the locking units 20*m*-1 and 20*m*-1' in the other direction. Accordingly, the second elastic body 20*m*-2 located at the other portion 20*m*-12 of the locking units 20*m*-1 and 20*m*-1' may be pressed together, and thus the second elastic body 20*m*-2 may be relatively compressed compared to the usual state in which external force is not applied to the second elastic body 20*m*-2, and the mouthpiece 10*m* and the locking units 20*m*-1 and 20*m*-1' may be uncoupled at a certain position.

In contrast, when the mouthpiece 10*m* moves from the open position to the closed position, because portions 20*m*-11 and 20*m*-11' of the locking units 20*m*-1 and 20*m*-1' have a curved shape or an oblique shape as described above, the one end of the mouthpiece 10*m* may at least partially press the locking units 20*m*-1 and 20*m*-1' and the second elastic body 20*m*-2 to the other direction.

When the mouthpiece 10*m* reaches the closed position, the locking units 20*m*-1 and 20*m*-1' may be inserted into the second airflow passage 150-2 of the mouthpiece 10*m*, and the second elastic body 20*m*-2 may press the locking units 20*m*-1 and 20*m*-1' again to one direction such that the mouthpiece 10*m* is held in the closed position.

According to an embodiment, the second elastic body 20*m*-2 may include at least one of a compression spring, a leaf spring, and a volute spring. The second elastic body 20*m*-2 may be designed according to the external force required for opening and closing the mouthpiece 10*m*. For example, the second elastic body 20*m*-2 may be a compression spring made of SUS, wherein the total length is 3 mm, the pitch is 1.5 mm, the wire diameter is about 0.2 mm to about 0.4 mm, the spring diameter is about 1.5 mm to about 2.5 mm, and the effective number of turns is 2.

FIG. 9 is a block diagram of an aerosol generating device 900 according to another embodiment.

The aerosol generating device 900 may include a processor 910, a sensing unit 920, an output unit 930, a battery 940, an atomizer 950, a user input unit 960, a memory 970, and a communication unit 980. However, the internal structure of the aerosol generating device 900 is not limited to those illustrated in FIG. 9. That is, according to the design of the aerosol generating device 900, it will be understood by one of ordinary skill in the art that some of the components shown in FIG. 9 may be omitted or new components may be added.

The sensing unit 920 may sense a state of the aerosol generating device 900 and a state around the aerosol generating device 900, and transmit sensed information to the processor 910. Based on the sensed information, the processor 910 may control the aerosol generating device 900 to perform various functions, such as controlling an operation of the atomizer 950, limiting smoking, determining whether an aerosol generating article (e.g., a cigarette, a cartridge, or the like) is inserted, displaying a notification, or the like.

The sensing unit 920 may include at least one of a temperature sensor 922, an insertion detection sensor, and an inhalation detecting sensor 926, but is not limited thereto.

The temperature sensor 922 may sense a temperature at which the atomizer 950 (or an aerosol generating material) is heated. The aerosol generating device 900 may include a separate temperature sensor for sensing the temperature of the atomizer 950, or the atomizer 950 may serve as a temperature sensor. Alternatively, the temperature sensor 922 may also be arranged around the battery 940 to monitor the temperature of the battery 940.

The insertion detection sensor 924 may sense insertion and/or removal of an aerosol generating article. For example, the insertion detection sensor 924 may include at least one of a film sensor, a pressure sensor, an optical sensor, a resistive sensor, a capacitive sensor, an inductive sensor, and an infrared sensor, and may sense a signal change according to the insertion and/or removal of an aerosol generating article.

The inhalation detecting sensor 926 may sense a user's puff on the basis of various physical changes in an airflow passage or an airflow channel. For example, the inhalation detecting sensor 926 may sense a user's puff on the basis of any one of a temperature change, a flow change, a voltage change, and a pressure change.

The sensing unit 920 may include, in addition to the temperature sensor 922, the insertion detection sensor 924, and the inhalation detecting sensor 926 described above, at least one of a temperature/humidity sensor, a barometric pressure sensor, a magnetic sensor, an acceleration sensor, a gyroscope sensor, a location sensor (e.g., a global positioning system (GPS)), a proximity sensor, and a red-green-blue (RGB) sensor (illuminance sensor). Because the function of each sensor may be intuitively inferred from the name by one of ordinary skill in the art, the specific explanation may be omitted.

The output unit 930 may output information on a state of the aerosol generating device 900 and provide the information to a user. The output unit 930 may include at least one of a display unit 932, a haptic unit 934, and a sound output unit 936, but is not limited thereto. When the display unit 932 and a touch pad form a layered structure to form a touch screen, the display unit 932 may also be used as an input device in addition to an output device.

The display unit 932 may visually provide information about the aerosol generating device 900 to the user. For example, information about the aerosol generating device 900 may mean various pieces of information, such as a charging/discharging state of the battery 940 of the aerosol generating device 900, a preheating state of the atomizer 950, an insertion/removal state of an aerosol generating article, or a state in which the use of the aerosol generating device 900 is restricted (e.g., sensing of an abnormal object), or the like, and the display unit 932 may output the information to the outside. The display unit 932 may be, for example, a liquid crystal display panel (LCD), an organic light-emitting diode (OLED) display panel, or the like. In addition, the display unit 932 may be in the form of a light-emitting diode (LED) light-emitting device.

The haptic unit 934 may tactilely provide information about the aerosol generating device 900 to the user by converting an electrical signal into a mechanical stimulus or an electrical stimulus. For example, the haptic unit 934 may include a motor, a piezoelectric element, or an electrical stimulation device.

The sound output unit 936 may audibly provide information about the aerosol generating device 900 to the user. For example, the sound output unit 936 may convert an electrical signal into a sound signal and output the same to the outside.

The battery 940 may supply power used to operate the aerosol generating device 900. The battery 940 may supply power such that the atomizer 950 may be heated. In addition, the battery 940 may supply power required for operations of other components (e.g., the sensing unit 920, the output unit 930, the user input unit 960, the memory 970, and the communication unit 980) in the aerosol generating device 900. The battery 940 may be a rechargeable battery or a disposable battery. For example, the battery 940 may be a lithium polymer (LiPoly) battery, but is not limited thereto.

The atomizer 950 may receive power from the battery 940 to heat an aerosol generating material. Although not illustrated in FIG. 9, the aerosol generating device 900 may further include a power conversion circuit (e.g., a direct current (DC)/DC converter) that converts power of the battery 940 and supplies the same to the atomizer 950. In addition, when the aerosol generating device 900 generates aerosols in an induction heating method, the aerosol generating device 900 may further include a DC/alternating current (AC) that converts DC power of the battery 940 into AC power.

The processor 910, the sensing unit 920, the output unit 930, the user input unit 960, the memory 970, and the communication unit 980 may each receive power from the battery 940 to perform a function. Although not illustrated in FIG. 9, the aerosol generating device 900 may further include a power conversion circuit that converts power of the battery 940 to supply the power to respective components, for example, a low dropout (LDO) circuit, or a voltage regulator circuit.

In an embodiment, the atomizer 950 may be formed of any suitable electrically resistive material. The heater may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater may be implemented by a metal wire, a metal plate on which an electrically conductive track is arranged, a ceramic heating element, or the like, but is not limited thereto.

In another embodiment, the atomizer 950 may be a heater of an induction heating type. For example, the atomizer 950 may include a susceptor that heats an aerosol generating material by generating heat through a magnetic field applied by a coil.

In another embodiment, the atomizer 950 may be a vibrator generating ultrasonic vibration. The vibrator may include, for example, piezoelectric ceramics. As electricity is applied to the vibrator, vibrations of short periods and high frequency may be generated, and the generated vibration may break down the aerosol generating material to small particles to thereby atomize to an aerosol.

The user input unit 960 may receive information input from the user or may output information to the user. For example, the user input unit 960 may include a key pad, a dome switch, a touch pad (a contact capacitive method, a pressure resistance film method, an infrared sensing method, a surface ultrasonic conduction method, an integral tension measurement method, a piezo effect method, or the like), a jog wheel, a jog switch, or the like, but is not limited thereto. In addition, although not illustrated in FIG. 9, the aerosol generating device 900 may further include a connection interface, such as a universal serial bus (USB) interface, and may connect to other external devices through the connection interface, such as the USB interface, to transmit and receive information, or to charge the battery 940.

The memory 970 is a hardware component that stores various types of data processed in the aerosol generating device 900, and may store data processed and data to be processed by the processor 910. The memory 970 may include at least one type of storage medium from among a flash memory type, a hard disk type, a multimedia card micro type memory, a card-type memory (for example, secure digital (SD) or extreme digital (XD) memory, etc.), random access memory (RAM), static random access memory (SRAM), read-only memory (ROM), electrically erasable programmable read-only memory (EEPROM), programmable read-only memory (PROM), a magnetic memory, a magnetic disk, and an optical disk. The memory 970 may store an operation time of the aerosol generating device 900, the maximum number of puffs, the current number of puffs, at least one temperature profile, data on a user's smoking pattern, etc.

The communication unit 980 may include at least one component for communication with another electronic device. For example, the communication unit 980 may include a short-range wireless communication unit 982 and a wireless communication unit 984.

The short-range wireless communication unit 982 may include a Bluetooth communication unit, a Bluetooth Low Energy (BLE) communication unit, a near field communication unit, a wireless LAN (WLAN) (Wi-Fi) communication unit, a Zigbee communication unit, an infrared data association (IrDA) communication unit, a Wi-Fi Direct (WFD) communication unit, an ultra-wideband (UWB) communication unit, an Ant+ communication unit, or the like, but is not limited thereto.

The wireless communication unit 984 may include a cellular network communication unit, an Internet communication unit, a computer network (e.g., local area network (LAN) or wide area network (WAN)) communication unit, or the like, but is not limited thereto. The wireless communication unit 984 may also identify and authenticate the aerosol generating device 900 within a communication network by using subscriber information (e.g., International Mobile Subscriber Identifier (IMSI)).

The processor 910 may control general operations of the aerosol generating device 900. In an embodiment, the processor 910 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor may be implemented in other forms of hardware.

The processor 910 may control the temperature of the atomizer 950 by controlling supply of power of the battery 940 to the atomizer 950. For example, the processor 910 may control power supply by controlling switching of a switching element between the battery 940 and the atomizer 950. In another example, a direct heating circuit may also control power supply to the atomizer 950 according to a control command of the processor 910.

The processor 910 may analyze a result sensed by the sensing unit 920 and control subsequent processes to be performed. For example, the processor 910 may control power supplied to the atomizer 950 to start or end an operation of the atomizer 950 on the basis of a result sensed by the sensing unit 920. As another example, the processor 910 may control, based on a result sensed by the sensing unit 920, an amount of power supplied to the atomizer 950 and the time the power is supplied, such that the atomizer 950 may be heated to a certain temperature or maintained at an appropriate temperature.

The processor 910 may control the output unit 930 on the basis of a result sensed by the sensing unit 920. For example, when the number of puffs counted through the inhalation detecting sensor 926 reaches a preset number, the processor 910 may notify the user that the aerosol generating device 900 will soon be terminated through at least one of the display unit 932, the haptic unit 934, and the sound output unit 936.

One embodiment may also be implemented in the form of a computer-readable recording medium including instructions executable by a computer, such as a program module executable by the computer. The computer-readable recording medium may be any available medium that can be accessed by a computer and includes both volatile and nonvolatile media, and removable and non-removable media. In addition, the computer-readable recording medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol generating device comprising: a cartridge comprising: a mouthpiece configured to move between an open position and a closed position; and a body portion configured to store an aerosol generating material and comprising a first airflow passage; and a main body comprising: a coupling portion detachably coupled to the cartridge; and a holding portion configured to hold the mouthpiece in the closed position, wherein the cartridge further comprises a first elastic body elastically supporting the mouthpiece toward the open position.

2. The aerosol generating device of claim 1, wherein the holding portion provides a holding force to one end of the mouthpiece to hold the mouthpiece in the closed position.

3. The aerosol generating device of claim 1, wherein
the mouthpiece is rotatable around a rotation shaft, and
the first elastic body is a torsion spring located at the rotation shaft of the mouthpiece.

4. The aerosol generating device of claim 1, wherein the holding portion comprises a locking unit that is coupled to the mouthpiece when the mouthpiece moves to the closed position such that the mouthpiece is held in the closed position.

5. The aerosol generating device of claim 4, wherein
the holding portion further comprises a second elastic body configured to press the locking unit in one direction, and
when the mouthpiece moves from the closed position to the open position, the second elastic body is pressed to another direction such that the mouthpiece and the locking unit are uncoupled.

6. The aerosol generating device of claim 1, wherein the mouthpiece comprises a second airflow passage of which one end is connected to an outside of the aerosol generating device, and of which another end is connected to the first airflow passage in the open position.

7. The aerosol generating device of claim 1, wherein
the cartridge further comprises an atomizer, and
the coupling portion comprises an accommodating groove accommodating the body portion, and a connection terminal electrically connected to the atomizer.

8. The aerosol generating device of claim 1, wherein the main body further comprises a cover comprising an opening having a size corresponding to the mouthpiece, and wherein the cover is coupled to one side of the main body to which the cartridge is coupled such that a coupling state of the cartridge and the main body is maintained.

9. The aerosol generating device of claim 1, wherein the cartridge further comprises:
an atomizer; and
a storage,
wherein the body portion further comprises:
a first housing forming a portion of the first airflow passage of the storage; and
a second housing coupled to the first housing, and forming remaining portions of the first airflow passage and an inner space accommodating the atomizer.

10. The aerosol generating device of claim 1, wherein the cartridge further comprises:
an atomizer;
a first conductor connected to one surface of the atomizer; and
a second conductor connected to another surface of the atomizer.

11. The aerosol generating device of claim 10, wherein the first conductor covers at least a portion of the one surface of the atomizer and at least a portion of an outer circumferential surface of the atomizer, and the second conductor elastically pressurizes the atomizer in a direction from the other surface of the atomizer to the one surface of the atomizer.

12. The aerosol generating device of claim 10, wherein the cartridge further comprises a circuit board electrically connected to the atomizer through the first conductor and the second conductor, and the circuit board comprises a resistor that eliminates noise of a signal applied to the atomizer.

13. The aerosol generating device of claim 1, wherein the cartridge further comprises:

an atomizer;

a storage;

a wick that absorbs the aerosol generating material stored in the storage; and an absorbing plate arranged to cover at least a portion of the atomizer and configured to retain the aerosol generating material absorbed by the wick.

14. The aerosol generating device of claim 1, wherein the main body further comprises an inhalation detecting sensor located at the coupling portion.

* * * * *